US006122470A

United States Patent [19]

Kimura

[11] Patent Number: 6,122,470

[45] Date of Patent: Sep. 19, 2000

[54] IMAGE FORMING APPARATUS

[75] Inventor: Noriyuki Kimura, Kanagawa, Japan

[73] Assignee: Ricoh Company, Ltd., Tokyo, Japan

[21] Appl. No.: 09/260,015

[22] Filed: Mar. 2, 1999

[30] Foreign Application Priority Data

Mar. 3, 1998 [JP] Japan ..... 10-069431
Jun. 16, 1998 [JP] Japan ..... 10-185654

[51] Int. Cl.[7] ..... G03G 15/01

[52] U.S. Cl. ..... 399/227

[58] Field of Search ..... 399/111, 112, 399/113, 119, 123, 124, 125, 126, 127, 226, 227, 262, 263

[56] References Cited

U.S. PATENT DOCUMENTS

| | | | |
|---|---|---|---|
| 5,331,390 | 7/1994 | Kimura et al. | 399/227 |
| 5,465,139 | 11/1995 | Kimura et al. | 399/260 |
| 5,537,197 | 7/1996 | Fujishiro et al. | 399/298 |
| 5,565,973 | 10/1996 | Fujishiro et al. | 399/227 |
| 5,583,630 | 12/1996 | Kimura et al. | 399/227 |
| 5,655,193 | 8/1997 | Fujishiro et al. | 399/256 |
| 5,671,465 | 9/1997 | Kimura et al. | 399/119 |
| 5,797,069 | 8/1998 | Kimura et al. | 399/227 X |

FOREIGN PATENT DOCUMENTS

| | | |
|---|---|---|
| 63-146077 | 6/1988 | Japan . |
| 1-135448 | 9/1989 | Japan . |
| 2-287577 | 11/1990 | Japan . |
| 6-332285 | 12/1994 | Japan . |
| 9-114179 | 5/1997 | Japan . |
| 10-177298 | 6/1998 | Japan . |

*Primary Examiner*—William Royer
*Assistant Examiner*—Hoan Tran
*Attorney, Agent, or Firm*—Oblon, Spivak, McClelland, Maier & Neustadt, P.C.

[57] ABSTRACT

In an image forming apparatus including a revolver type developing unit, a cover member surrounds a plurality of developing sections arranged on the developing unit. The cover member is formed with an opening at a developing position facing a photoconductive belt or similar image carrier, and ribs extending in the axial direction of a rotary shaft around which the developing sections are arranged. The cover member therefore deforms little and protects developing rollers and other constituents of the developing unit from damage while causing a minimum of toner to fly about.

20 Claims, 23 Drawing Sheets

IMAGE FORMING APPARATUS

BACKGROUND OF THE INVENTION

The present invention relates to a copier, facsimile apparatus, printer or similar image forming apparatus and more particularly to an improved cover member enclosing a plurality of developing sections arranged on a revolver type developing unit.

It is a common practice with a full-color copier or similar full-color image forming apparatus to sequentially expose an image carrier to image light representative of images of different separated colors to thereby form latent images. The latent images are developed by toner of colors complementary to the color-separated light to turn out toner images. The toner images are sequentially transferred to a paper or similar recording medium one above the other, forming a full-color image. A multicolor image forming apparatus sequentially exposes an image carrier to images to be reproduced in different colors and thereby sequentially forms latent images. These latent images each are developed by a developer of particular color. The resulting toner images are sequentially transferred to a paper one above the other. This type of image forming apparatus, whether it be full-color or multicolor, needs a plurality of developing devices for developing latent images in different colors. The problem with such developing devices is that they increase the overall size of the apparatus when constructed independently of each other and arranged around the image carrier.

In light of the above, a revolver type developing unit having a plurality of developing sections arranged on a rotary body has been proposed in various forms in the past. The rotary body is positioned in the vicinity of an image carrier. The developing unit is rotatable to bring any one of the developing sections to a developing position for developing a latent image formed on the image carrier with toner stored in the developing section.

For example, Japanese Patent Publication No. 4-23782 and Japanese Patent Laid-Open Publication No. 4-29166 each disclose an image forming apparatus constructed to replace the entire revolver type developing unit when any one of the developing sections reaches a toner end condition. This kind of apparatus has a problem that even a developing section holding a sufficient amount of toner must be discarded, wasting the toner and thereby increasing the running cost. For example, the images of ordinary documents are mostly output in black and white. The ratio of images output in black and white to images output in color is generally understood to be 9:1 to 7:3. This means that black toner is consumed far more than toner of colors other than black, and therefore much of the toner of colors other than black is simply wasted. Further, because the developing unit is replaced as soon as a toner end condition occurs, even members not reached the end of life must be discarded. Moreover, a system and facilities for collecting, disassembling and recycling the developing unit made up of various materials are essential and increase the initial cost and running cost.

Japanese Utility Model Laid-Open Publication No. 4-38362 proposes an image forming apparatus including a revolver type developing unit storing black toner in a greater amount than toner of colors other than black. This kind of apparatus reduces the waste of toner of colors other than black and therefore reduces the increase of the running cost, compared to the apparatuses of the above Publication No. 4-23782 and Laid-Open Publication No. 4-29166. Even this apparatus, however, cannot fully obviate the waste of toner because the amount of consumption depends on the toner. In addition, the apparatus, like the apparatuses of the above documents, increases the substantial initial cost and running cost.

Japanese Patent Laid-Open Publication No. 61-97674 and Japanese Patent Publication No. 6-5403 each disclose an image forming apparatus including a plurality of toner cartridges fixedly mounted on the body of the apparatus and each storing toner of particular color therein. The toner cartridges each are connected to a particular developing section of a revolver type developing unit by a flexible tube. A toner conveyor member is disposed in each flexible tube and caused to rotate in accordance with the consumption of the associated toner so as to replenish fresh toner to the associated developing section. However, the prerequisite with this configuration is that the flexible tubes and toner conveyor members must be prevented from twisting. The apparatus, therefore, needs a connecting section for selectively interrupting the connection between the developing sections and the tubes in accordance with the condition of rotation of the developing unit. In addition, the connecting section must be provided with shutters and seal members for preventing toner from flying about and leaking and preventing toner of different colors form being mixed. As a result, the apparatus needs a complicated construction including a great number of parts, resulting in an increase in initial cost.

Japanese Patent Publication NO. 7-43551 teaches an image forming apparatus including toner replenishing means arranged at one end of a revolver type developing unit and a slider slidably supporting the developing unit. This kind of apparatus is capable of replenishing toner of particular color to each developing section without resorting to the above connecting section. The apparatus, however, must have the parts of the developing unit to be cleaned, inspected, adjusted and replaced and must, when use is made of a two-ingredient type developer, have the carrier of the developer periodically replaced. That is, the operator has not only to replenish toner but also to maintain the developing unit periodically. The above slider is used to facilitate such maintenance work. However, the slider has a complicated and rigid configuration and thereby increases the initial cost of the body of the apparatus. Moreover, the developing unit must be bodily replaced when the life of any one of the developing sections expires, noticeably increasing the running cost. Black toner, for example, is consumed far more than toner of colors other than black, as stated earlier. It follows that the developing section storing black toner is used far more frequency than the other developing sections. Therefore, if all the developing section have the same durability, then the developing section storing black toner reaches the end of life earlier than the other developing sections. This requires the developing section storing black toner to have high reliability and high maintenance ability.

Japanese Patent Laid-open Publication Nos. 60-208779, 61-73163 and 61-103175 each propose an image forming apparatus in which the developing sections of a revolver type developing unit are implemented as cartridges or magazines disposable independently of each other. In this apparatus, only if the developing unit is rotated to bring desired one of the cartridges or magazines to a preselected position for replacement, it can be removed from the apparatus, as shown and described in, e.g., the above Laid-Open Publication Nos. 60-208779 and 61-103175. However, the miniaturization and cost reduction of the developing unit available with this apparatus are limited because each developing section needs respective end walls and casing and because a particular support member must be assigned to each developing section. Moreover, the operator must maintain the developing sections one by one, resulting in time- and labor-consuming work. For example, the developing sections storing toner other than black toner are used at substantially the same rate and usually reach the end of life almost at the same time, although the amount of consumption depends on the toner. Such developing sections are, in many cases, replaced at the same time.

Japanese Patent Publication No. 59-26954, Japanese Patent Laid-Open Publication Nos. 60-233669, 6-85266 and 62-102261, Japanese Utility Model Laid-Open Publication No. 63-26847 and Japanese Patent Laid-Open Publication No. 63-41871 each disclose an image forming apparatus constructed to miniaturize the revolver type developing unit and therefore the entire apparatus and to output black-and-white images stably with high quality. This apparatus includes an exclusive black developing unit for development in black and a revolver type developing unit (simply revolver hereinafter) arranged in the vicinity of a photoconductive element or image carrier. The black developing unit stores black toner. The revolver is rotatable to bring any one of its developing sections to a preselected developing position. The operator is capable of handling the black developing unit used more frequently than the developing sections of the revolver independently of the revolver type developing unit. This facilitates the maintenance of the black developing unit. However, some different problems are apt to occur, depending on the configuration of each of the two developing units. For example, the apparatus taught in the above Laid-Open Publication No. 60-233669 needs particular end plates and a particular casing for each of the three developing sections arranged thereon, and a particular support plate for each of the three developing sections. This limits the miniaturization and cost reduction of the revolver. In addition, handling the three developing sections one by one results in time- and labor-consuming maintenance work.

To solve the above problems, Japanese Patent Laid-Open Publication No. 9-114179 discloses an image forming apparatus including a cartridge storing black toner and a revolver having developing sections storing toner of colors different from black. Toner of particular color is replenished to each of the developing sections of the revolver in accordance with the consumption of toner. With this apparatus, it is possible to facilitate the manipulation of the cartridge assigned to black and used more often than the revolver and the manipulation of the revolver in which each toner is consumed in a particular amount. Further, a toner replenishing device is located at one end of the revolver and conveys toner in the axial direction of the rotary shaft of the revolver. This miniaturizes the revolver and toner replenishing device and enhances the free layout of the inside of the apparatus. However, the apparatus lacks a member for protecting the periphery of the revolver. It is therefore likely that the developing rollers of the revolver are scratched when the cartridge storing black toner is mounted and dismounted from the apparatus. Further, toner is apt to fly out of the developing units and contaminate the inside of the apparatus. In addition, black toner is apt to fly out of the cartridge and be mixed with toner stored in the revolver.

Japanese Patent Laid-Open Publication No. 10-177298 teaches an image forming apparatus including a hollow cylindrical cover member surrounding a revolver and formed with an opening facing a developing position where an image carrier is present. Handles are provided on the cover member such that they can be retracted to closely contact the circumference of the cover member. The cover member is a solution to the problem of the above Laid-Open Publication No. 9-114179.

However, if the mechanical strength of the above cover member is short, then the cover member is apt to deform when the black developing unit contacts the cover member and exerts a force thereon during mounting or dismounting. The deformation of the cover member is likely to damage developing rollers and other members arranged in the revolver. Further, when the cover member is implemented by, e.g., a molding of resin, it is apt to bend, distort or otherwise deform during molding or machining. This also brings about damage to the structural parts of the revolver and causes toner on the developing rollers to fly about.

Technologies relating to the present invention are also disclosed in, e.g., Japanese Patent Laid-Open Publication Nos. 6-332285, 63-146077 and 2-287577, and Japanese Utility Model Laid-Open Publication No. 1-135448.

SUMMARY OF THE INVENTION

It is therefore an object of the present invention to provide an image forming apparatus capable of reducing damage to developing rollers included in a revolver type developing unit and the flying of toner ascribable to the deformation of a cover member.

An image forming apparatus of the present invention includes an image carrier for forming a latent image thereon, a revolver type first developing unit having a plurality of developing sections arranged around a rotary shaft, and a cover member covering the developing sections and formed with an opening at a developing position facing the image carrier. The first developing unit is rotatable to locate any one of the developing sections at the developing position to thereby develop the latent image. The cover member includes ribs extending in the axial direction of the rotary shaft.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
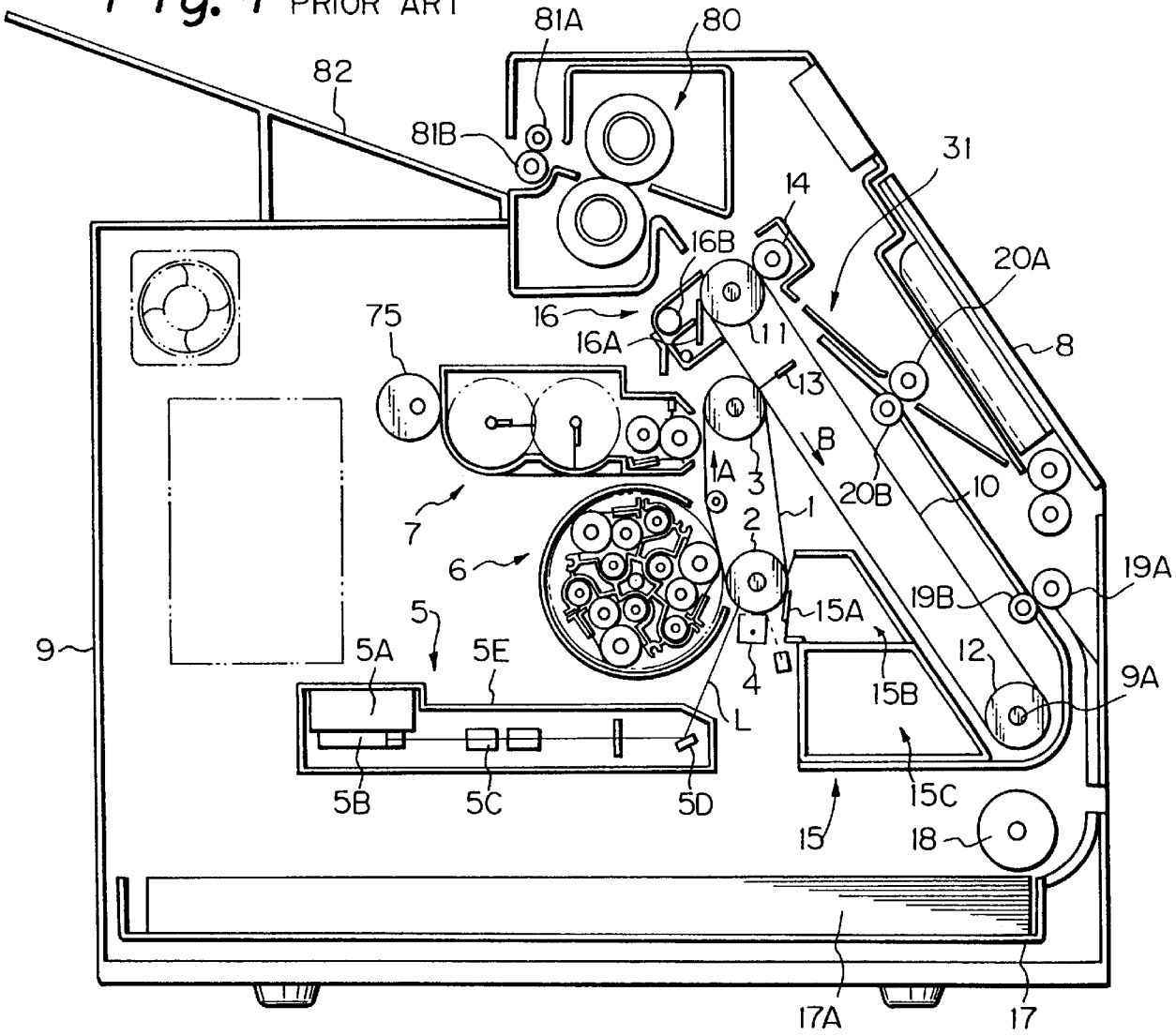
Fig. 1 PRIOR ART
FIG. 1 is a section showing a conventional color image forming apparatus including a cover member.

To better understand the present invention, a specific construction of a conventional color image forming apparatus having a cover member around a revolver type developing unit will be described with reference to FIG. 1. As shown, the color image forming apparatus includes an image carrier implemented by a flexible photoconductive belt 1. The belt 1 is passed over a pair of rollers 2 and 3 and caused to turn by the rollers 2 and 3 in a direction indicated by an arrow A (clockwise). Arranged around the belt 1 are a charger or charging means 4, a laser writing unit 5, a revolver type color developing unit 6, and a black developing unit 7. The charger 4 uniformly charges the surface of the belt l. The laser writing unit 5 is an exposing device for forming a latent image on the belt 1. The color developing unit 6 has three developing sections storing a yellow, a magenta and a cyan developer, respectively. The black developing unit 7 is provided independently of the color developing unit 6 and stores a black developer.

The laser writing unit 5 is arranged in a lower portion of the apparatus and includes a unit case 5E accommodating a semiconductor laser, not shown, a polygonal mirror 5B, an f-θ lens 5C, and a mirror 5D. The polygonal mirror 5B is caused to rotate by a drive motor 5A. A bottom plate, not shown, is positioned between the laser writing unit 5 and a paper cassette 17. The laser writing unit 5 is mounted on the top of the bottom plate. The bottom plate is connected to a front and a rear side wall, as seen in the direction perpendicular to the sheet surface of FIG. 1, included in the apparatus and supporting the various units of the apparatus, although not shown specifically.

A position where the charger 4 charges the belt 1, a position where the writing unit 5 scans the belt 1 with a laser beam L and a position where a cleaning blade 15A cleans the belt 1 adjoin the part of the belt 1 passed over the lower roller 2.

The color developing unit 6 and black developing unit 7 each have developing rollers or a developing roller, respectively, playing the role of a developer carrier. Each of the developing rollers is capable of adjoining or contacting the belt 1 at a preselected position, as will be described specifically later. The developing units 6 and 7 each develop a latent image electrostatically formed on the belt 1 by either one of contact development or non-contact development.

An intermediate transfer belt 10 is held in contact with the portion of the belt 1 passed over the upper roller 3. The intermediate transfer belt 10 is passed over a pair of rollers 11 and 12 and held in an inclined position, as illustrated. The rollers 11 and 12 drive the belt 10 in a direction indicated by an arrow B in FIG. 1 (counterclockwise). The left run of the belt 10, as viewed in FIG. 1, contacts the above-mentioned portion of the belt 1. A toner image formed on the belt 1 is transferred to the belt 10 by a conductive bias brush 13 contacting the back of the belt 10 under a preselected condition. Let the image transfer from the belt 1 to the belt 10 be referred to as primary transfer. In this sense, the bias brush 13 plays the role of a primary transfer member. A transfer roller 14 is movable into and out of contact with the portion of the belt 10 passed over the roller 11. The transfer roller 14 transfers a composite color image formed on the belt 10 to a paper or similar recording medium. The image transfer from the belt 10 to a paper will be referred to as secondary transfer. In this sense, the transfer roller 14 serves as a secondary transfer member. Positions assigned to the primary transfer and secondary transfer, respectively, are remote from each other by a distance greater than the maximum image output length, as measured on the circumference of the belt 10.

A cleaning unit 15 for the belt 1 includes a receptacle 15B for collecting waste toner, in addition to the cleaning blade 15A for cleaning the belt 1. A cleaning unit 16 for the intermediate transfer belt 10 includes a cleaning blade 16A and an auger 16B for conveying collected toner. While image formation is under way, the cleaning blade 16A is released from the surface of the belt 10. The cleaning blade 16A is brought into contact with the belt 10 only during cleaning effected after secondary transfer.

In operation, while the charger 4 uniformly charges the surface of the belt 1, the laser writing unit 5 scans the charged surface of the belt 1 with the laser beam L modulated in accordance with image data. As a result, a latent image is electrostatically formed on the belt 1. At this instant, the image data is one of yellow, magenta cyan and black color data separated from a desired full-color image. The laser beam L issuing from the semiconductor laser in accordance with the image data is steered by the polygonal mirror 5B rotating at a high speed and then incident to the mirror 5D via the f-θ lens 5C.

The color developing unit 6 sequentially develops each of latent images sequentially formed on the belt 1 with particular one of yellow toner, magenta toner and cyan toner. The black developing unit 7 develops a latent image derived from black data with black toner. As a result, toner images of different colors are sequentially formed on the belt 1.

A preselected bias for image transfer is applied to the bias brush 13. The bias brush 13 sequentially transfers a yellow, a magenta, a cyan and a black toner image from the belt 1 to the intermediate transfer belt 10 one above the other; the belt 10 is rotated in synchronism with the belt 1. A paper 17A is fed from the paper cassette 17 by a pick-up roller and a pair of registration rollers 20A and 20B to the image transfer position where the transfer roller 14 contacts the intermediate transfer belt 10. The transfer roller 14 transfers the composite toner image or full-color image from the belt 10 to the paper 17A. After the image transfer, a fixing unit 80 fixes the full-color image on the paper 17A. Finally, the paper 17A is driven out to a stacking section 82 via a pair of outlet rollers 81A and 18B.

The belts 1 and 10, charger 4, cleaning unit 16 and registration roller 20B are constructed into a single process cartridge 31. The receptacle 15C for collecting waste toner is removably mounted to the process cartridge 31. A part of the process cartridge 31 where the registration roller 20B is mounted serves as a paper guide at the same time.

The waste toner scraped off by the cleaning blade 16A from the intermediate transfer belt 10 is conveyed by the auger 16B to the front, as seen in the direction perpendicular to the sheet surface of FIG. 1. A conveyor, not shown, mounted on the front side wall conveys the waste toner handed over from the auger 16B to the receptacle 15C. When more than a preselected amount of waste toner is collected in the receptacle 15C, the receptacle 15C is replaced. This extends the life of the process cartridge 31.

Figure 2:
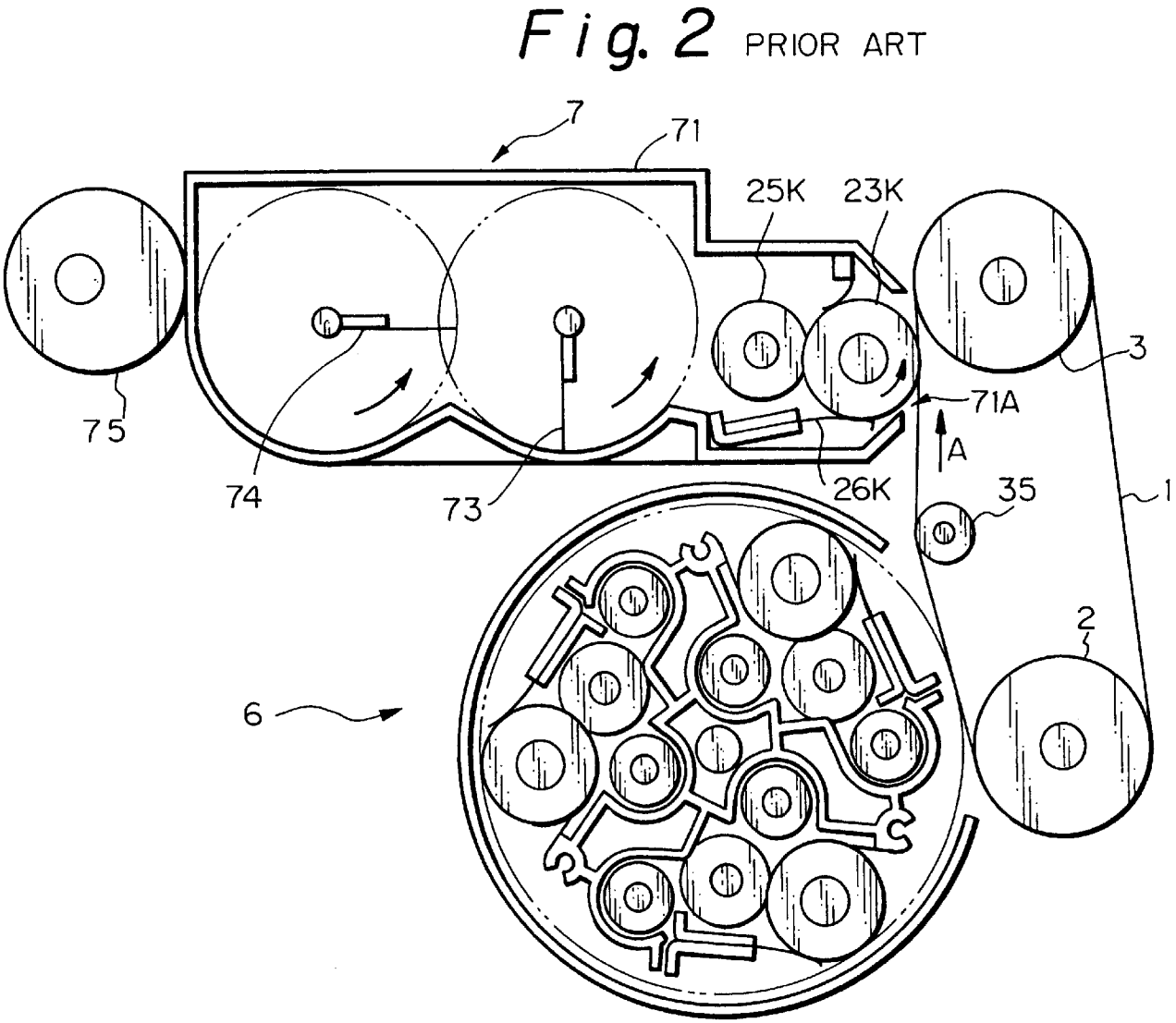
Fig. 2 PRIOR ART
FIG. 2 is a section showing a color developing unit and a black developing unit included in the apparatus of FIG. 1 specifically.

FIG. 2 shows the configuration of the black developing unit 7 and that of the color developing unit 6 specifically. As shown, the black developing unit 7 includes a case 71 storing the black developer (black toner). A developing roller or developer carrier 23K is disposed in the case 71 and faces the belt 1 via an opening 71A formed in the case 71. The developing unit 7 is implemented as a cartridge to be replaced when it runs out of the toner. A toner supply roller 25K is also disposed in the case 71 in parallel to the developing roller 23K and pressed against the roller 23K by a preselected pressure. The toner supply roller 25K moves in the opposite direction to the developing roller 23K, as seen at a position. where the former contacts the latter, while forming a nip. The toner supply roller 25K is formed of, e.g., foam polyurethane. A doctor blade 26K adjoins the opening 71A at a position downstream of the position where the two rollers 23K and 25K contact in the direction of movement of the roller 23K. The doctor blade or regulating member 26K remains in contact with the developing roller 23K at its edge portion and is implemented by a thin resilient sheet of, e.g., stainless steel or formed of urethane rubber or similar elastic material.

A first agitator 73 is positioned in the case 71 for agitating the toner while conveying it to the toner supply roller 25K and developing roller 23K. A second agitator 74 conveys the toner to the first agitator 73 while agitating it. Rotary shafts on which the two agitators 71 and 74 are respectively mounted are parallel to the rollers 25K and 23K. The agitators 73 and 74 each have a film-like elastic sheet at its edge. The elastic sheet rubs itself against the bottom of the case 71 in order to efficiently convey the toner existing in the case 71. This is successful to reduce the amount of toner to be left in the case 71. The agitators 73 and 74 should be rotated at a speed as low as possible in order to free the toner from excessive stress.

Figure 3:
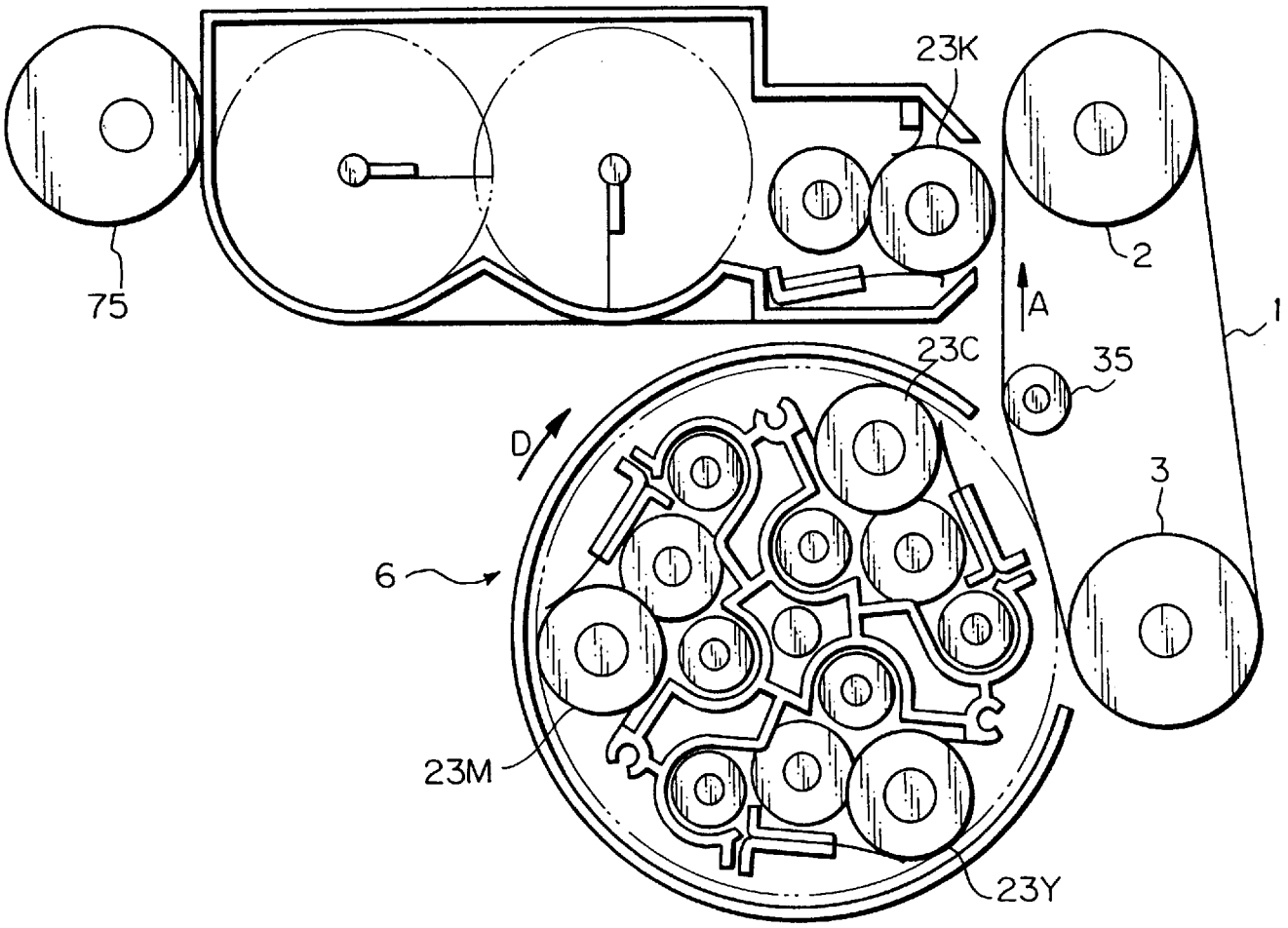
Fig. 3 PRIOR ART
FIG. 3 is a section showing the color developing unit and black developing unit in a non-image forming condition.

The black developing unit 7 is movable toward and away from the belt 1 in the horizontal direction. The developing unit 7 is spaced from the belt 1 when it is not used. At the time of development, the developing unit 7 is moved toward the belt 1 as far as a developing position where the developing roller 23K adjoins or contacts the belt 1. As shown in FIG. 3, the developing unit 7 is usually held in the position where the developing roller 23K is released from the belt 1. To develop a latent image in black, a cam 75 moves the entire developing unit 7 along a guide, not shown, to the position where the developing roller contacts the belt 1 and forms a preselected nip between it and the belt 1.

While the developing roller 23K is released from the belt 1, it is not driven in order to prevent the toner from flying out or leaking via the opening 71A and to protect the constituents of the developing unit 7 including the developing roller 23K from early deterioration.

Figure 4:
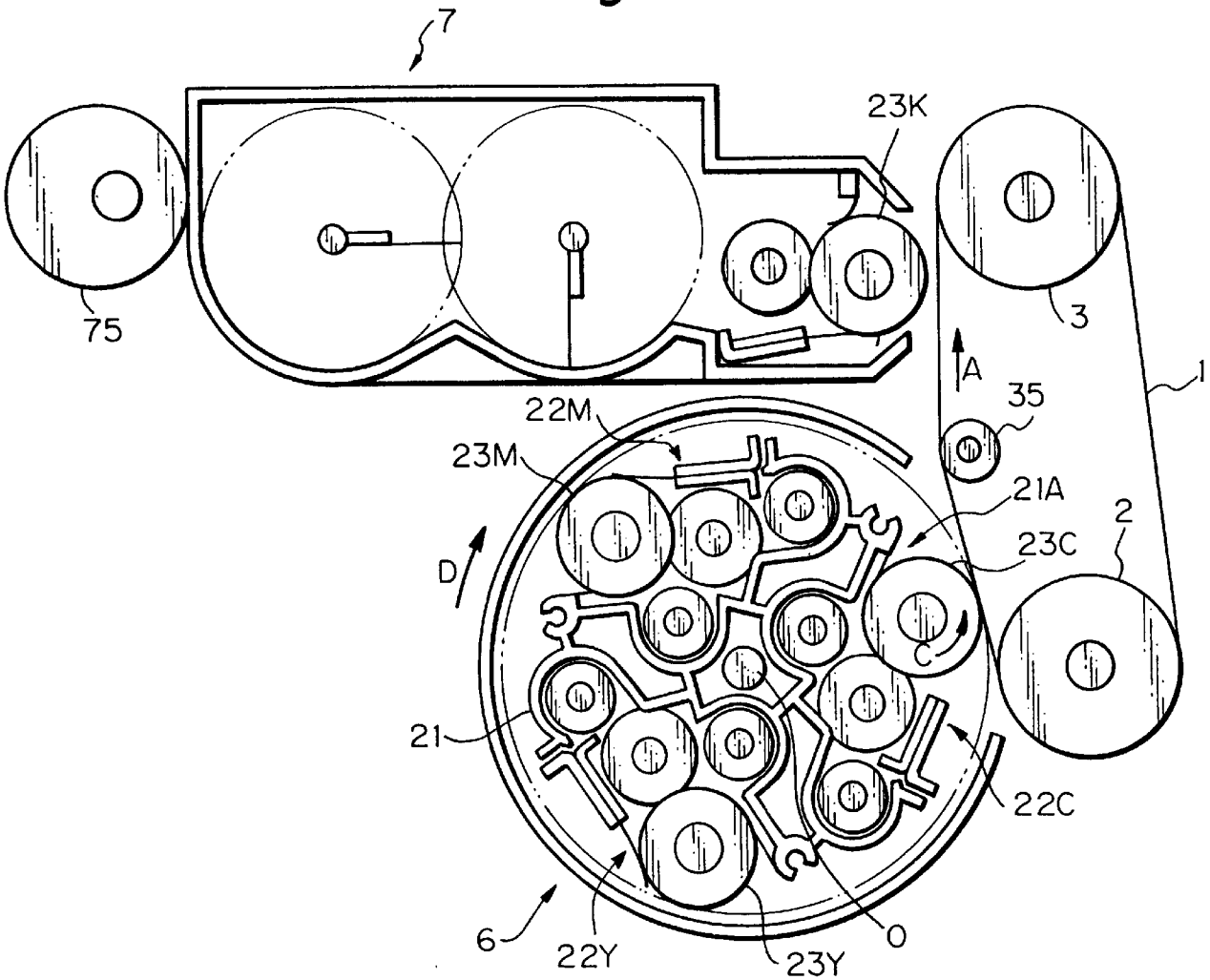
Fig. 4 PRIOR ART
FIG. 4 is a view similar to FIG. 4, showing the two developing units in a color developing condition.

FIG. 4 shows the color developing unit 6 in a specific position where a cyan developing section included in the unit 6 is held at a developing position assigned to the unit 6. As shown, the developing unit 6 has a casing 21 thereinside. The casing 21 is rotatable about a shaft 0 in a direction indicated by an arrow D (clockwise) by being driven by a drive mechanism not shown. The casing 21 has a yellow, a magenta and a cyan developing sect ion 22Y, 22M and 22C, respectively. The developing sections 22Y–22C are identical in construction and operation. Developing rollers or developer carriers 23Y, 23M and 23C are disposed in the developing sections 22Y, 22M and 22C, respectively. The developing rollers 23Y–23C are selectively brought to the developing position so as to face the belt 1 via an opening 21A formed in the casing 21. When any one of the developing rollers 23Y–23C is located at the developing position, the roller is rotated by a drive mechanism, not shown, in a direction indicated by an arrow C so as to develop a latent image in synchronism with image data. At this instant, the black developing unit 7 is spaced from the belt 1 by the cam 75 and a spring or similar means, not shown, maintaining the developing roller 23K spaced from the belt 1.

The developing sections 22Y–22C respectively store yellow toner, magenta toner and cyan toner, i.e., single-ingredient type developers. The casing 21 is rotated about the shaft 0 in order to bring necessary one of the developing sections 22Y–22C to the developing position.

Arrangements inside the color developing unit 6 will be described more specifically. Because the developing sections 22Y–22C are identical in construction and operation, let the following description concentrate on the cyan developing unit 22C by way of example.

Figure 5:
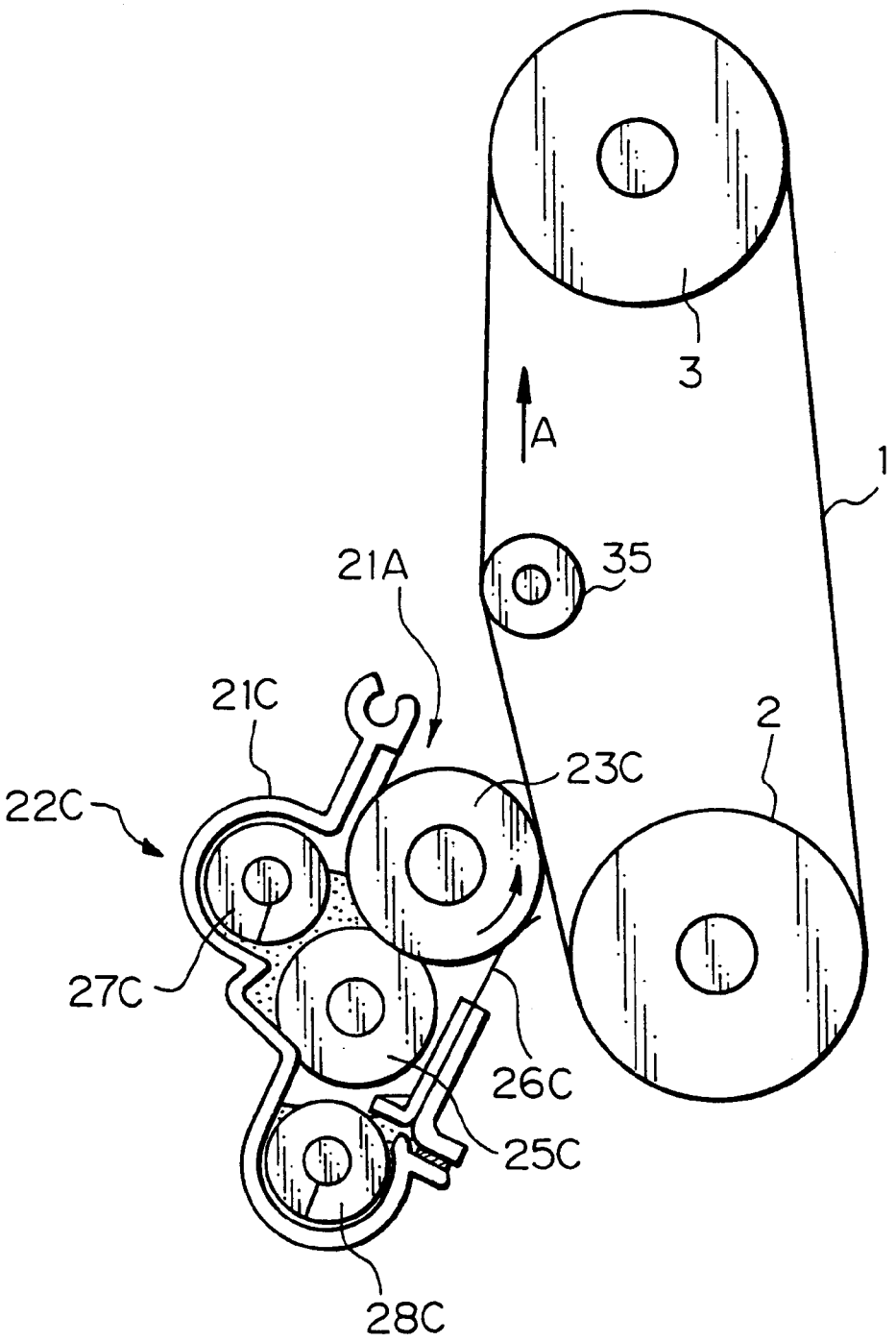
Fig. 5 PRIOR ART
FIG. 5 is a section showing the arrangement of a cyan developing section included in the color developing unit specifically.

As shown in FIG. 5, a backup roller 35 is pressed against the back of the left run of the belt 1 adjoining the color developing unit 6 in such a manner as press it outward. In this condition, the upper portion of the left run of the belt 1, as viewed in FIG. 5, moves vertically while the lower portion of the same moves slightly obliquely. The black developing unit 7 and color developing unit 6 respectively face the upper portion and lower portion of the left run of the belt 1 with respect to the backup roller 35.

An opening 21A is formed in the upper portion of the cyan developing section 22C. A developing roller 23C is positioned in the opening 21A so as to face the belt 1. The developing roller 23C is rotatable in the direction C at a preselected ratio in peripheral speed to the belt 1. The developing roller 230 and belt 1 move in the same direction as each other, as seen at the position where they face each other. A toner supply roller or toner supply member 25C is positioned below the developing roller 23C and held in sliding contact with the roller 23C. The toner supply roller 25C is formed of foam urethane or similar elastic material. The toner supply roller 25C is rotated at a preselected ratio in peripheral speed to the developing roller 23C. The two rollers 23C and 25C move in the same direction as each other, as seen at the position where they contact each other.

A doctor blade or regulating member 26C is located in the vicinity of the opening 21A and downstream of the position where the two rollers 23C and 25C contact each other in the direction of movement of the roller 23C. The doctor blade 26C is implemented by a thin resilient sheet of, e.g., stainless steel or formed of urethane rubber or similar elastic material. The edge portion of the doctor blade 26C is held in contact with the developing roller 23C. A screw or first conveying member 27, which will be described later, conveys the toner from the front to the rear in the direction perpendicular to the sheet surface of FIG. 5.

Figure 6:
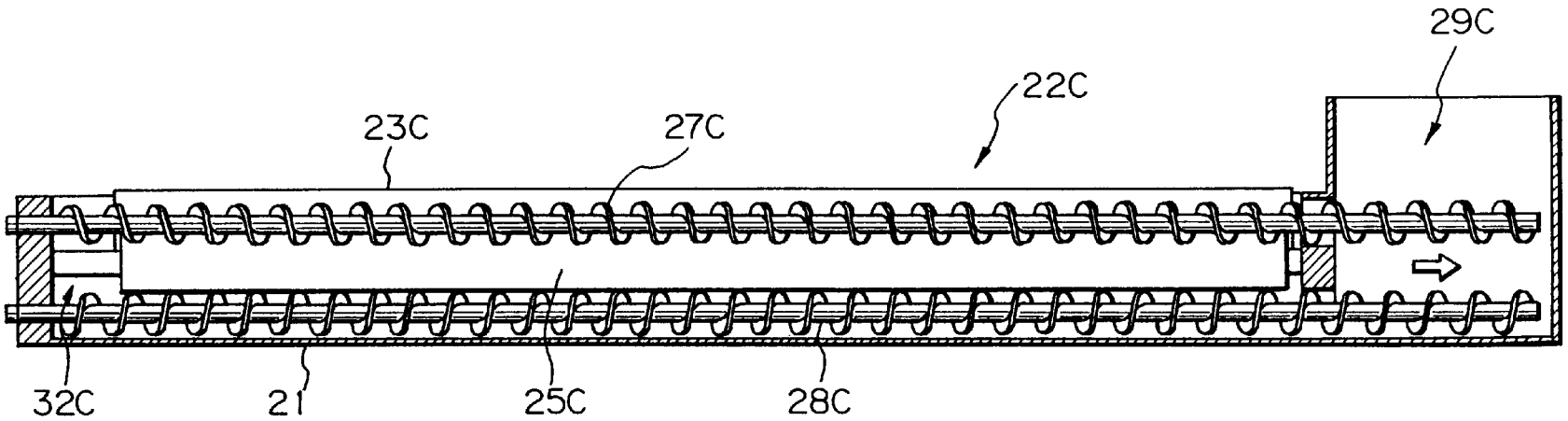
Fig. 6 PRIOR ART
FIG. 6 is a section of the cyan developing unit as seen from the side.

As shown in FIG. 6, a toner storing portion 29C is located at one end of the color developing unit 6 in the axial direction of the developing roller 23C (front end in FIG. 5). The screw 27C extends from the toner storing section 29C to the other end of the developing unit 6, i.e., to the rear side wall of the developing section 22c, as viewed in FIG. 5. The screw 27C is parallel to the developing roller 23C and toner supply roller 25C.

The casing 21 partly contacts the toner supply roller 25C. The casing 21 therefore forms a space for toner conveyance around the screw 27C in cooperation with the developing roller 23C and toner supply roller 25C.

The screw 27C conveys the toner from the front to the rear, as viewed in FIGS. 4 and 5, in interlocked relation to the developing roller 23C and toner supply roller 25C. For this purpose, the screw 27C is rotated at a preselected ratio in linear velocity to each of the rollers 23C and 25C. The screw 27C conveys the toner from the toner storing portion 29C to the above space surrounding the screw 27C, thereby delivering the toner to the toner supply roller 25C. The toner supply roller 25C feeds the toner to the developing roller 23C while charging it by friction. The toner transferred from the roller 25C to the roller 23C is regulated to a preselected thickness by the doctor blade 26C. At the developing position, the toner is transferred from the roller 23C to the belt 1 for developing a latent image.

A part of the toner not used for development is conveyed by the screw 27C to the rear of the developing section 22C opposite to the toner storing portion 29C. This part of the toner arrives at a toner circulating portion 32C positioned outside of the effective diameter portion in the axial direction of the rollers 23C and 25C, and then drops to the bottom of the developing section 22C due to gravity.

Another screw or second toner conveying member 28C is positioned at the bottom of the developing section 22C when the section 22C is held at the developing position. The screw 28C is parallel to the two rollers 23C and 25C and screw or first toner conveying member 27C and conveys the toner in the opposite direction to the screw 27. The screw 28C conveys the toner brought to the toner circulating portion 32C to the toner storing portion 29C. Only if the two screws 27C and 28C each are control led to convey an adequate amount of toner, the toner can be fed to the toner supply roller 25C without resorting to the detection of the amount of toner existing in the developing section 22C or sophisticated toner supply control. This enhances the free layout of the color developing unit 6 and thereby reduces the size of the unit 6, i.e., the sectional area, which the unit 6 occupies relative to the belt 1.

Figure 7:
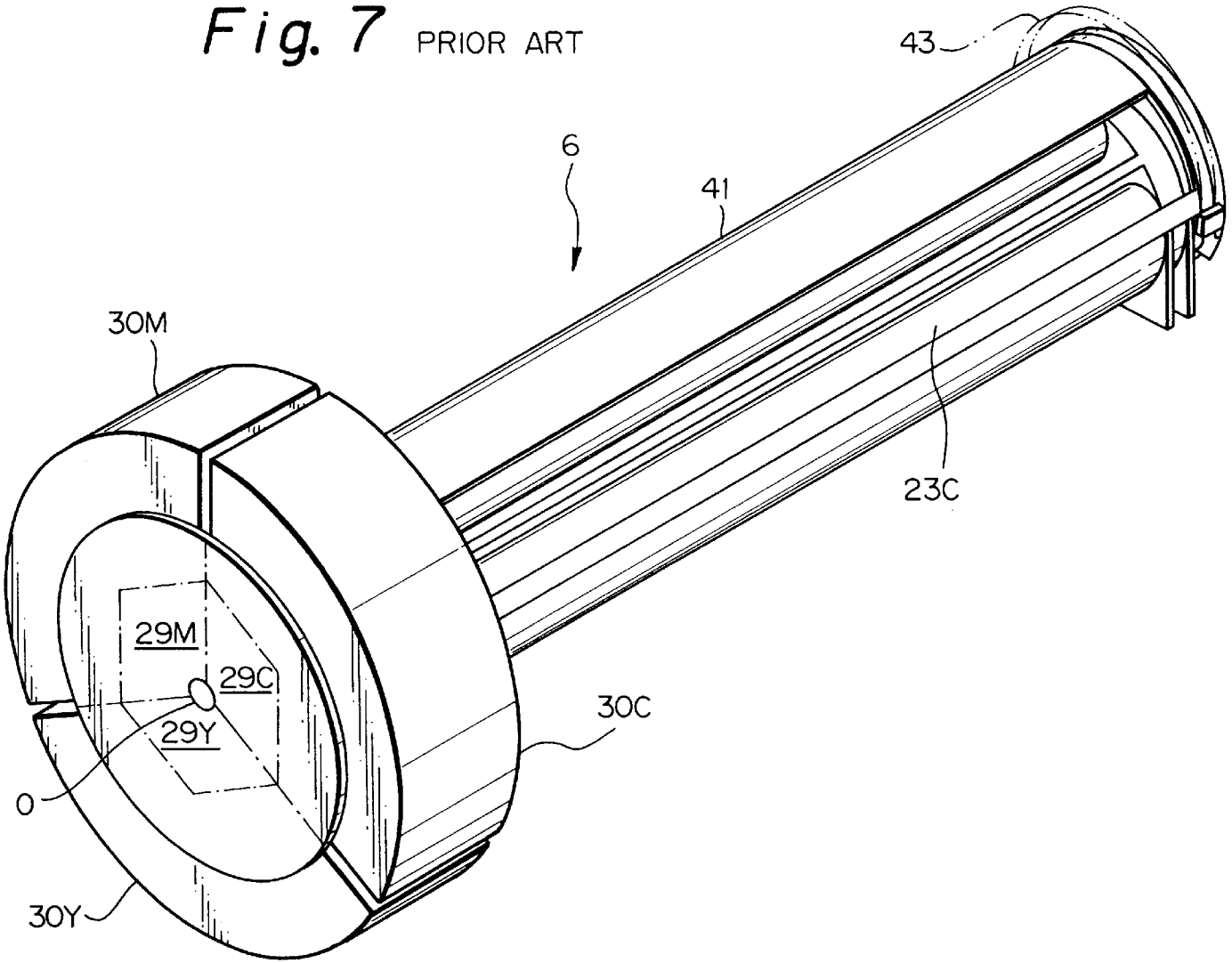
Fig. 7 PRIOR ART
FIG. 7 is a perspective view of the color developing unit.

FIG. 7 shows toner cartridges 30Y, 30M and 30C removably mounted to the color developing unit 6. The toner cartridge 30C, for example, is removably mounted to the toner storing portion 29C when the color developing unit 6 is newly mounted to the apparatus. When the cartridge 30C runs out of toner, it is replaced in order to allow a necessary amount of toner to constantly exist in the toner storing portion 29C. Such a configuration is also true with the other toner cartridges 30Y and 30M.

The black developing unit 7 has its developing roller 23K released from the belt 1 by the cam 75 and spring when it is not used, as stated with reference to FIG. 3. When the color developing unit 6 is not used, i.e., before and after its operation, it is held in a home position shown in FIG. 3. At the home position of the color developing unit 6, substantially the intermediate point between the developing rollers 23C and 23Y of the developing units 22C and 22Y, respectively, faces the belt 1, maintaining the rollers 23C and 23Y released from the belt 1. Such a home position allows the cyan developing section 22C, which is to be used first, to reach the developing position rapidly and accurately when the color developing unit or revolver rotates in the direction D, FIG. 3, at the beginning of development. In addition, when the revolver is out of operation, the above home position protects the belt 1 and developing rollers 23 from deterioration and scratches ascribable to their contact and prevents the toner from depositing or sticking to unexpected regions.

Figure 8:
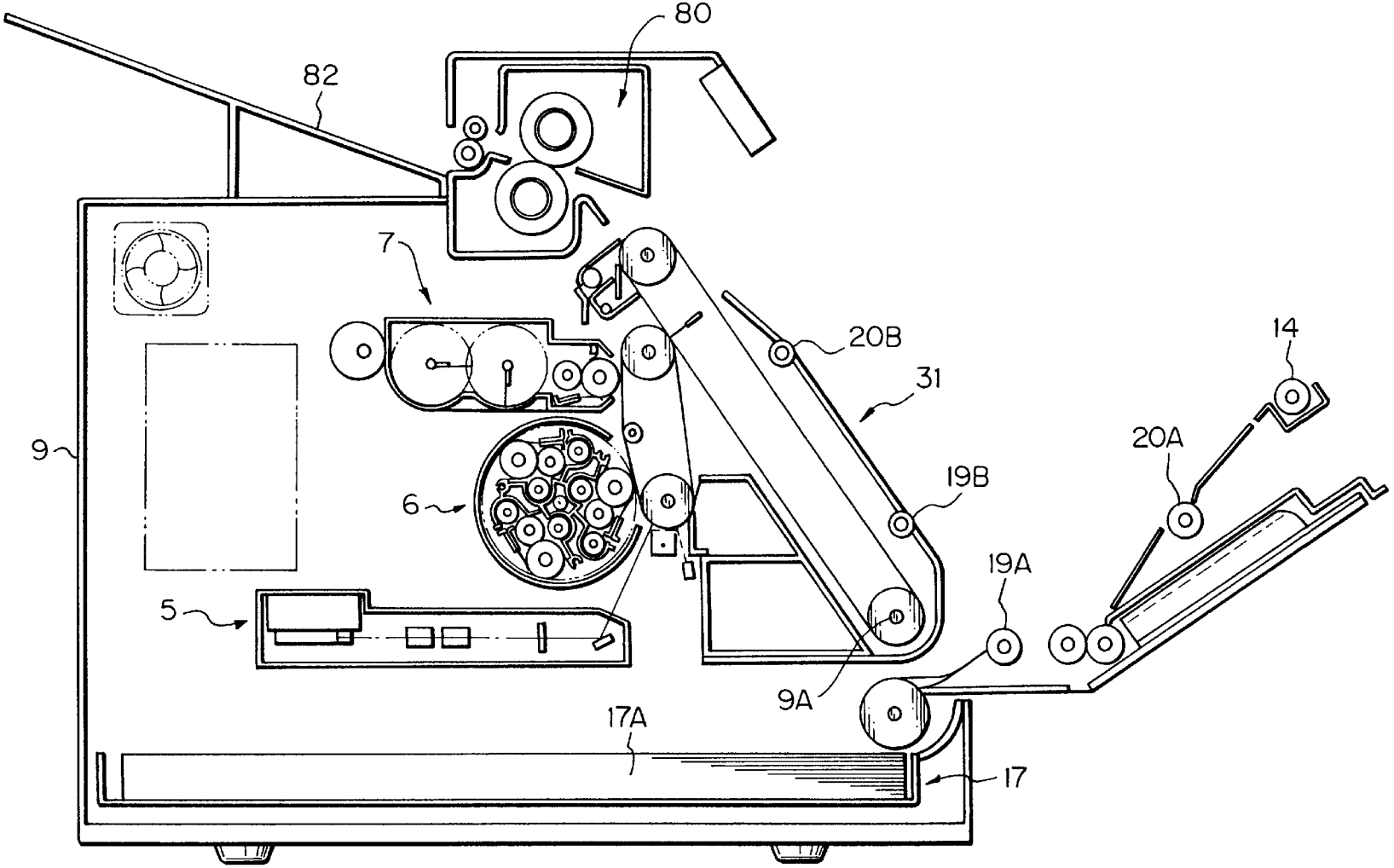
Fig. 8 PRIOR ART
FIG. 8 is a section showing a front frame included in the apparatus in an open position.

The body of the color image forming apparatus will be described with reference to FIGS. 1 and 8. As shown, the body includes a body frame or unmovable frame 9 and a front frame or movable frame 8 openable to uncover a transport path assigned to the paper 17A. The paper cassette 17 is positioned in the lower portion of the body frame 9. The color developing unit 6, black developing unit 7 and process cartridge 31 are replaceably arranged in the center portion of the body frame 9. The fixing unit 80 is positioned above the units 6 and 7 and cartridge 31.

The front frame 8 is rotatable about a shaft 9A and usually held in a closed position shown in FIG. 1. When the paper 17A jams the transport path, the operator unlocks the front frame 8 via an unlocking mechanism, not shown, and then turns the front frame 8 outward in the clockwise direction to a position shown in FIG. 8. A tension spring, for example, may be used to maintain the front frame 8 in the open position. The registration roller 20A and transfer roller 14 are mounted on the front frame 8. Therefore, in the position shown in FIG. 8, the front frame 8 uncovers the sheet transport path and allows the operator to remove the jamming sheet 17A.

Figure 9:
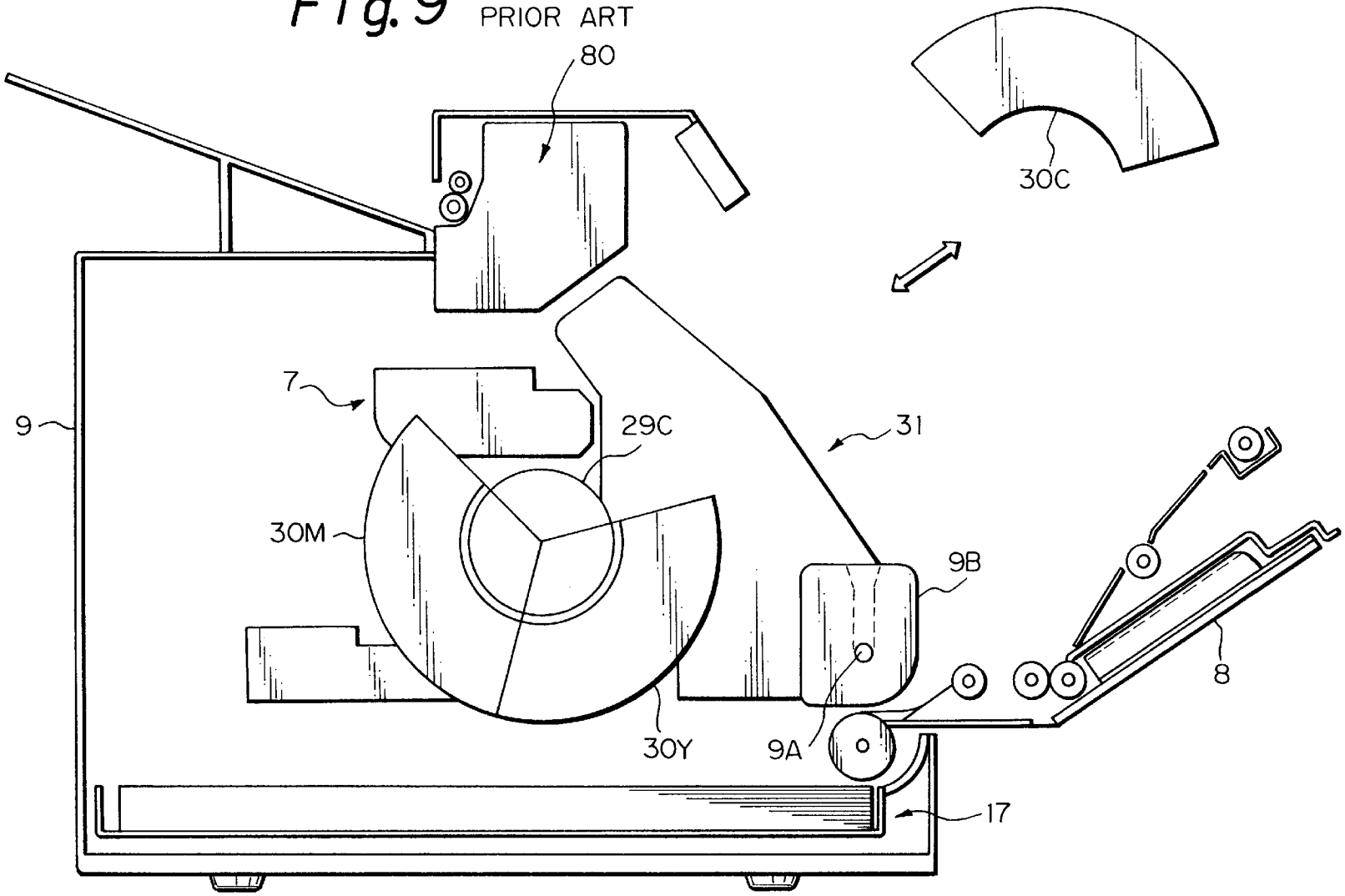
Fig. 9 PRIOR ART
FIG. 9 shows how a toner cartridge is mounted and dismounted from the apparatus.

When the cyan toner, for example, stored in the cyan developing section 22C decreases below a preselected amount, conventional toner end sensing means, not shown, senses the end of the toner and causes a message for urging the operator to replace the toner cartridge 30C to be displayed. In response, the operator opens the front frame 8 and replaces the toner cartridge 30C in the condition shown in FIG. 9.

Figure 10:
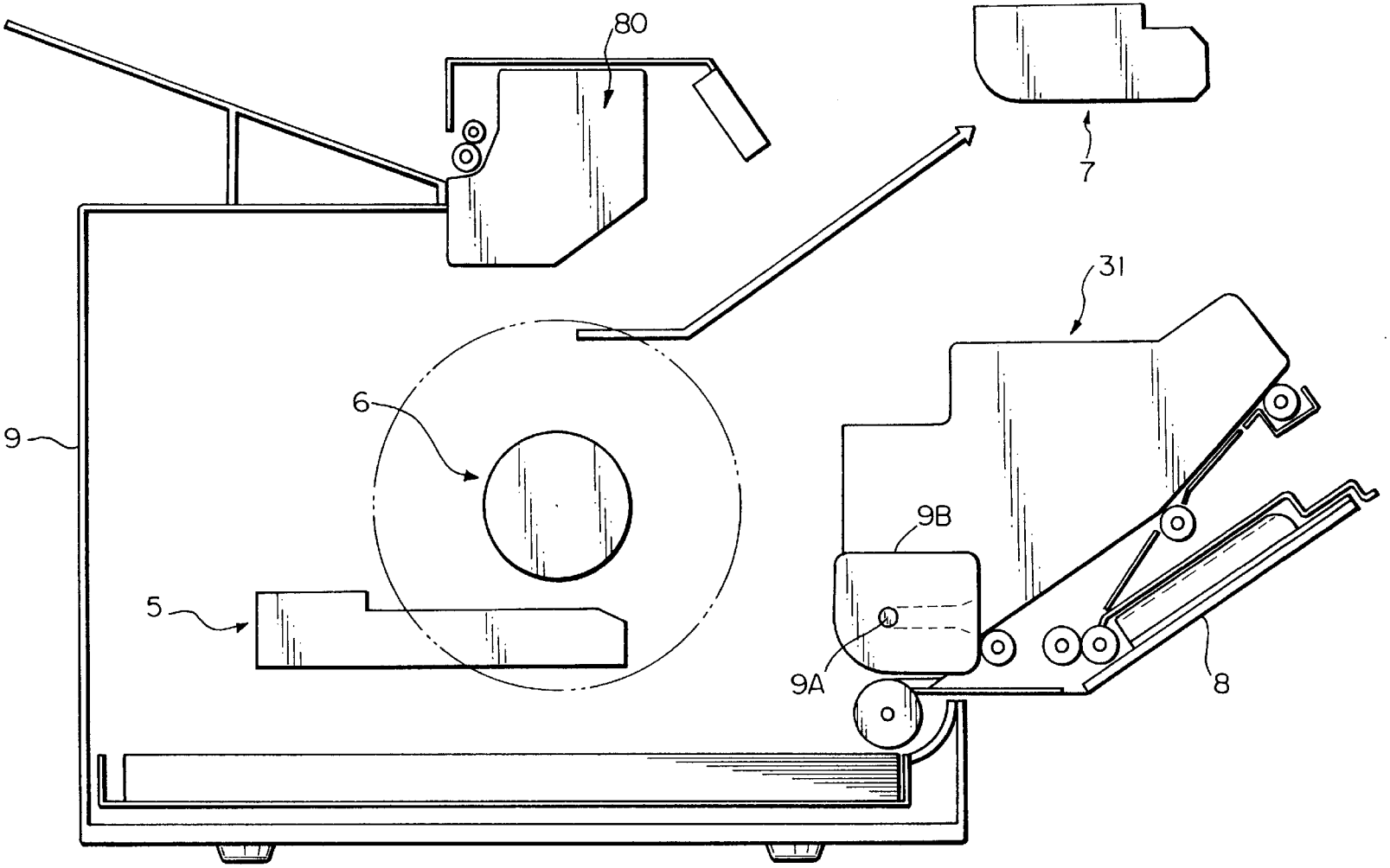
Fig. 10 PRIOR ART
FIG. 10 shows how the black developing unit is mounted to and dismounted form the apparatus.

Reference will be made to FIG. 10 for describing the mounting and dismounting of the black developing unit 7. The black developing unit 7 is implemented as a cartridge or so-called developer/toner magazine. When black toner in the developing unit 7 decreases below a preselected amount, a conventional optical sensor, magnetic sensor, piezoelectric sensor or similar toner sensing means, not shown, senses it. As a result, a message for urging the operator to replace the developing unit 7 appears on, e.g., a display panel provided on the apparatus.

A subframe 9B is mounted on the shaft 9A together with the front frame 8. The process cartridge 31 is removably mounted to the subframe 9B. To replace the developing unit 7, the operator rotates the subframe 9B about the shaft 9A together with the frame 8 to a position shown in FIG. 10. As a result, an opening broad enough for the operator to replace the developing unit 7 is formed. That is, the operator can easily replace the developing unit 7 without removing the process cartridge 31.

Figure 11:
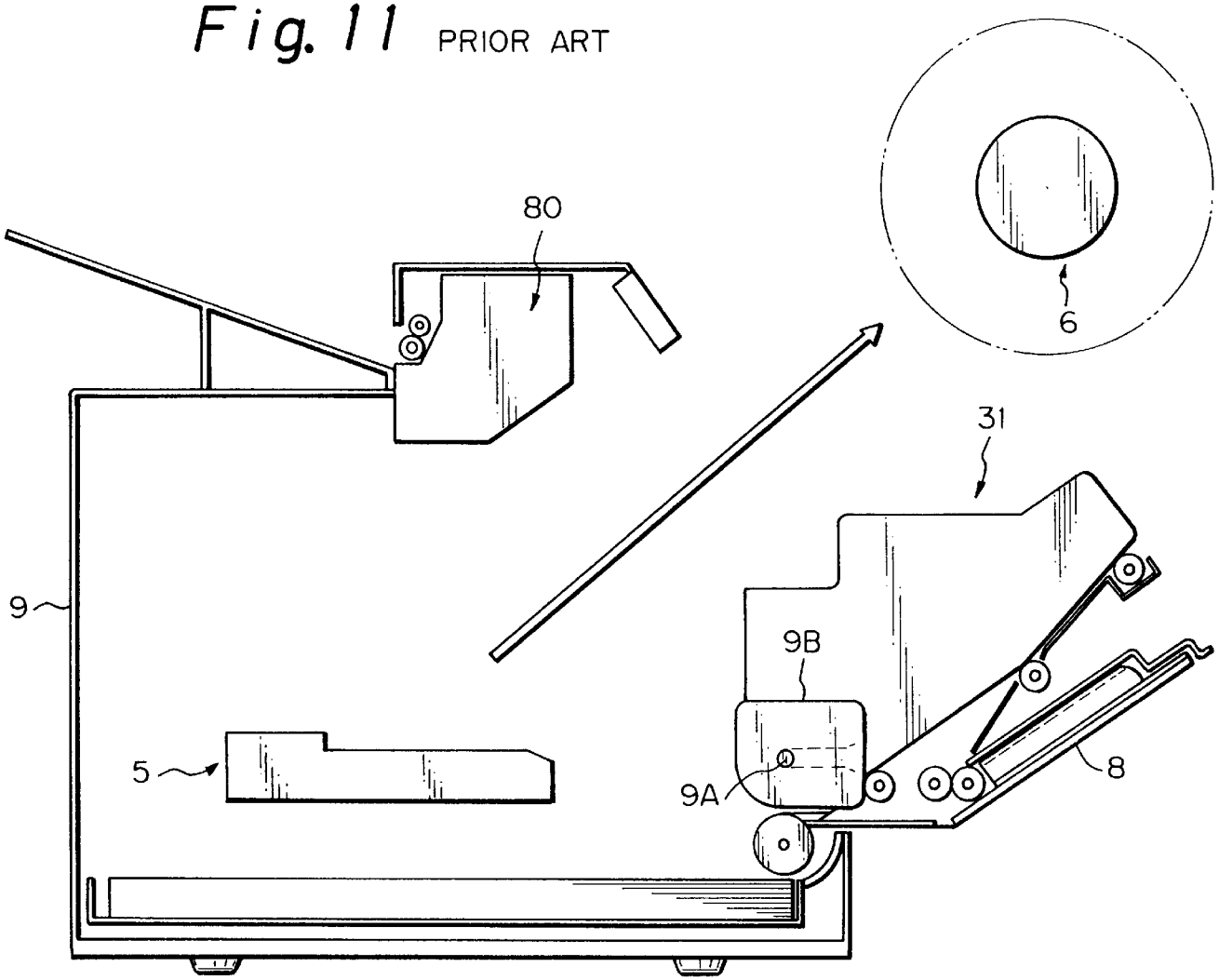
Fig. 11 PRIOR ART
FIG. 11 shows how the color developing unit is mounted and dismounted from the apparatus.

How the color developing unit 6 is replaced will be described with reference to FIG. 11. In a usual full-color image forming mode, yellow toner, magenta toner and cyan toner are consumed at substantial ly the same rate. The black developing unit 7 is replaced when it has produced, e.g., several thousands of printings due to its limited capacity. By contrast, the color developing unit 6 having the three different developing sections is bodily replaced when used to produce, e.g., several ten thousands of color printings in order to reduce the frequency of replacement, to enhance easy operation, and to reduce the cost of the unit 6 in a long term. When the amount of use (number of color printings) of the developing unit 6 stored in, e.g., a memory reaches a preselected value, information showing that the unit 6 has reached the end of life is displayed on, e.g., the display panel. Subsequently, when the toner end condition of the black developing unit 7 is detected, information urging the operator to replace the two developing units 7 and 6 at the same time is displayed on the display panel. In response, the operator rotates the subframe 9B about the shaft 9A together with the front frame 8 to the position shown in FIG. 11 and then replaces the color developing unit 6.

Figure 12:
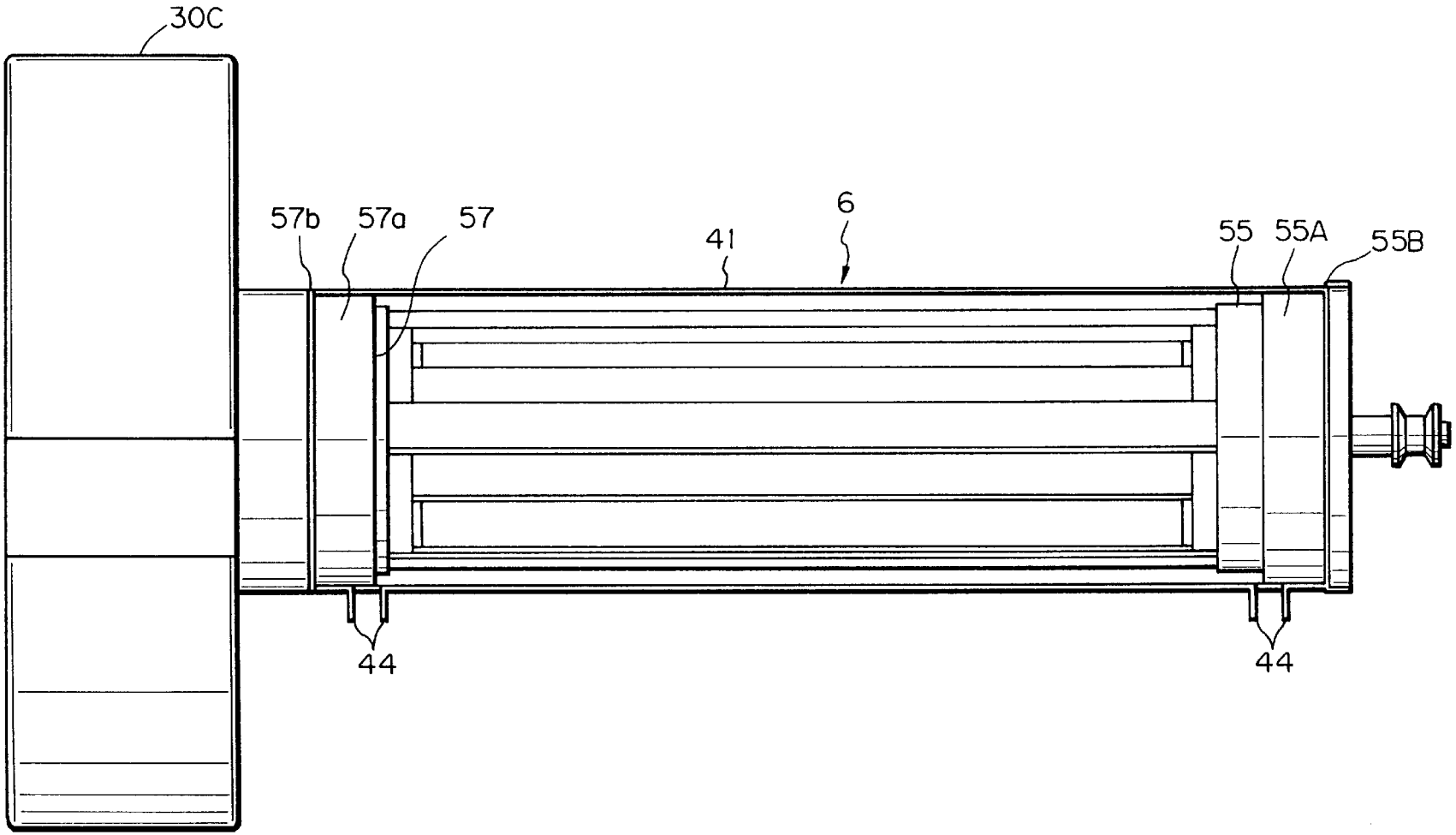
Fig. 12 PRIOR ART
FIG. 12 is a fragmentary section of the color developing unit as seen from the side.

Referring to FIG. 12, the color developing unit 6 has disk-like end plates 55 and 57 at its opposite ends with respect to the lengthwise direction. The end plates 55 and 57 are held in close contact with both ends of the casing 21, delimiting the three developing sections. Disk-like slide portions 55A and 57A respectively protrude axially outward from the end plates 55 and 57 and have the same diameter as the end plates 55 and 57. Stop portions 55B and 57B respectively protrude axially outward from the slide portions 55A and 57A and have a larger diameter than the slide portions 55A and 57A.

A cover member 41 is held between the stop portions 55B and 57B and rotatable in sliding contact with the slide portions 55A and 57A. Specifically, the cover member 41 has an inside diameter larger than the outside diameter of the slide portions 55A and 57A, but smaller than the outside diameter of the stop portions 55B and 57B. In this condition, the cover member 41 is rotatable relative to the body of the developing unit 6, but restricted by the stop portions 55B and 57B in the direction of thrust.

Figure 13:
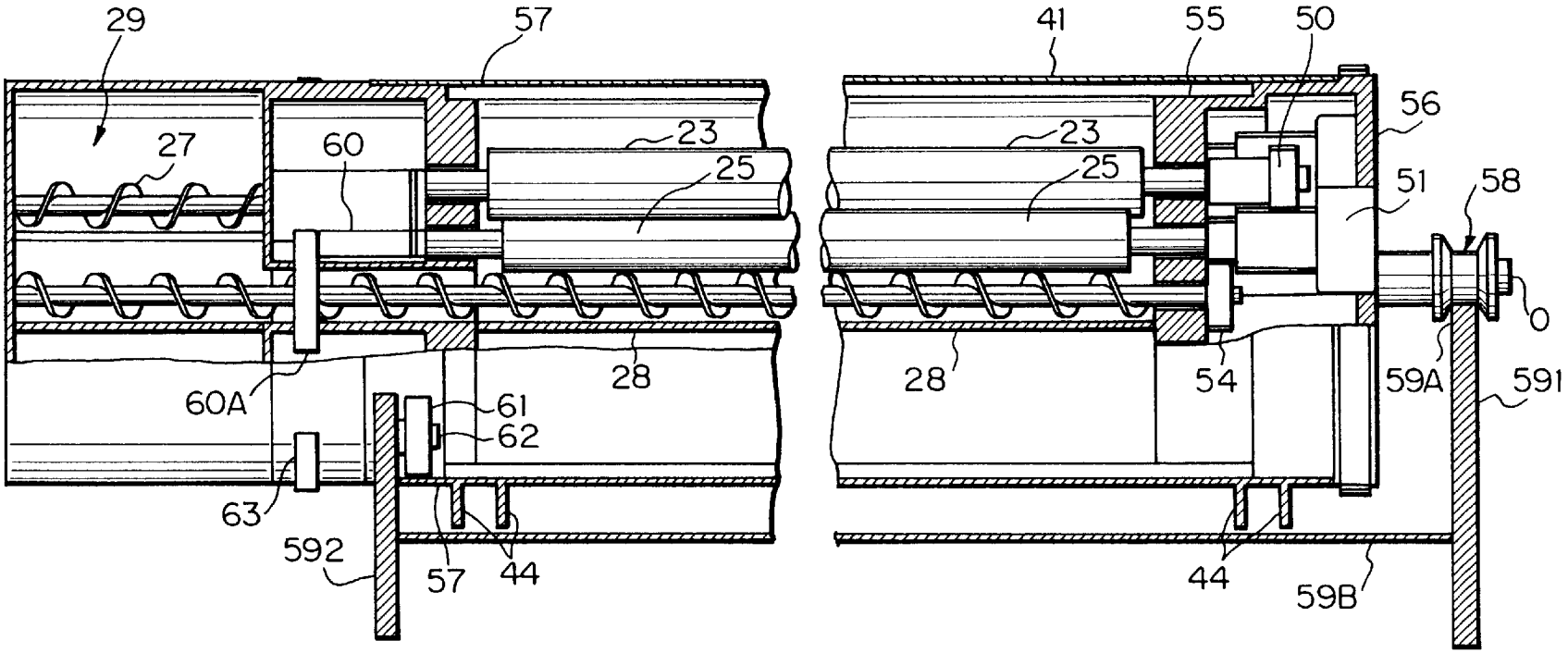
Fig. 13 PRIOR ART
FIG. 13 is a fragmentary section of one developing section of the color developing unit as seen from the side.

As shown in FIG. 13 in a fragmentary section, the end plate 55 located at the right-hand side (drive side) has a stepped circumference and has a bore thereinside. A coupling gear 51, a gear 50 mounted on the shaft of the developing roller 23 and a gear 54 mounted on the shaft of the screw 28, which are assigned to each of the developing sections 22Y–22C, are arranged in the bore of the end plate 55. A disk-like drive cover 56 is affixed to the end of the end plate 55 and formed with holes corresponding in position to the coupling gear 51 and center shaft 0 as well as holes, not shown, assigned to the other coupling gears. In this configuration, the drive section of the developing unit 6 is not exposed to the outside of the apparatus. This prevents impurities from entering the driveline and damaging it and insures safety operation.

The outside diameter of the drive cover 56 and the diameter of the hole assigned to the center shaft 0 as well as positional accuracy are adequately selected to insure the mechanical strength of the hollow end plate 55 and the positional accuracy of the end plate 55 relative to the center shaft.

A positioning roller 58 is coaxially mounted on the portion of the center shaft 0 outside of the drive cover 56 and freely rotatable relative to the shaft 0. The body of the apparatus includes a side wall 591 having a contact portion 59A. When the developing unit 6 is mounted to the body of the apparatus, the positioning roller 58 is engaged with the contact portion 59A and positions the drive side of the developing unit 6.

The end plate 57 located at the left-hand side in FIG. 13, like the end plate 55, has a stepped circumference and has a bore thereinside. E-rings, for example, are respectively fitted on the ends of the shafts of the developing roller 23 and toner supply roller 25 positioned in the bore of the end plate 57, restricting the rollers 23 and 25 in the direction of thrust. Resilient electrode plates 60 are respectively mounted on the ends of the above shafts and formed of, e.g., phosphor bronze. This kind of configuration is similarly applied to the other developing sections of the developing unit 6. A part of the electrode plate 60 extends from the inside to the outside of the cylindrical portion of the end plate 57 and forms a contact portion 60A extending along the circumference of the end plate 57.

A bias electrode 63 is mounted on the body of the apparatus and connected to a high-tension power source not shown. The bias electrode 63 is also resilient. When the casing 21 of the developing unit 6 is rotated to bring a certain developing section to the developing position, the contact portion 60A slidingly contacts the bias electrode 63. As a result, a preselected bias is applied form the high-tension power source to the developing section.

In the above construction, the developing roller 23 and toner supply roller 25 share a single bias. Alternatively, the contact portions 60A and bias electrodes 63 may be connected in parallel in order to apply a particular bias to each of the two rollers 23 and 25 at the same time.

A stub 62 is affixed to a side wall 592 also included in the apparatus and adjoining the toner storing portion 29. A support roller 61 is freely rotatable on the stub 62. Another stub and support roller, not shown, are mounted on the side wall 592. When the developing unit 6 is mounted to the body of the apparatus, the support rollers 61 support the outer circumference of the end plate 57 and thereby position the developing unit.

Figures 14A, 14B:
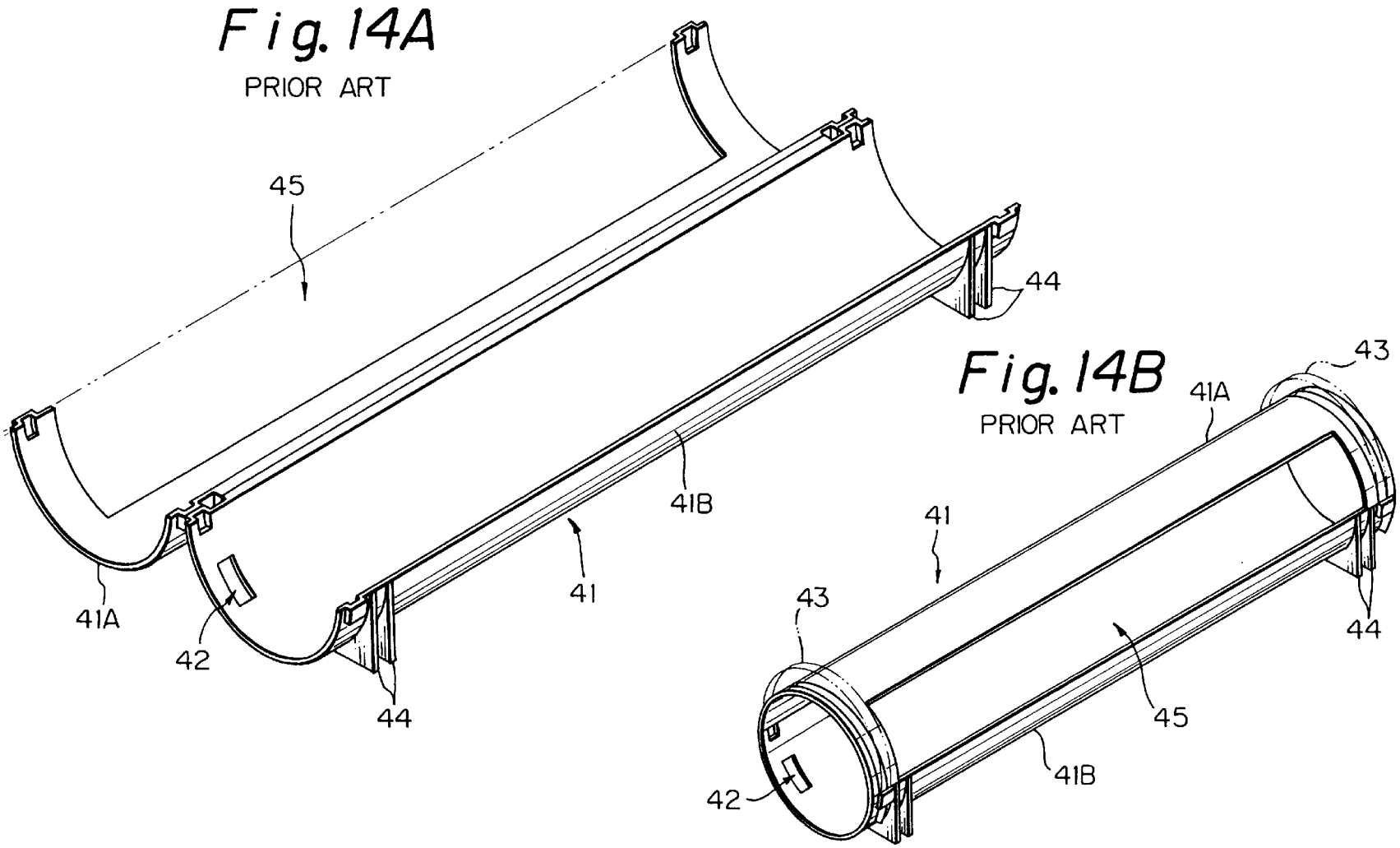
Fig. 14B PRIOR ART
Fig. 14A PRIOR ART
FIGS. 14A and 14B are perspective view of the cover member.

The cover member 41 stated earlier surrounds the outer circumference 57A of the end plate 57 included in the color developing unit 6. As shown in FIGS. 14A and 14B, the cover member 41 is formed with a hole 42 aligning with the support roller 61 when the developing unit 6 is set on the apparatus body. The outer circumference 57A of the end plate 57 is supported by the outer circumference of the support roller 61 and surrounded by the cover member 41. This protects the outer circumference 57A needing utmost accuracy for the positioning of the developing section from damage. Specifically, toner and other impurities are prevented from depositing on the outer circumference 57A, so that the position of the developing section remains extremely accurate at all times.

Seats 44 are formed on the bottom opposite ends of the cover member 41. The seats 44 each have a flat bottom and allow the developing unit 6 removed from the apparatus body to be stably positioned on, e.g., a desk. When the developing unit 6 is mounted to the apparatus body, the seats 44 are slightly spaced from a stop portion 59B included in the apparatus body. In this configuration, even when the developing sections 22 of the developing unit 6 rotate, as stated earlier, the seats 44 and stop portion 59B prevent the cover member 41 from being rotated. That is, only the developing sections 22 slidingly rotate relative to the cover member 41.

Figure 15A:
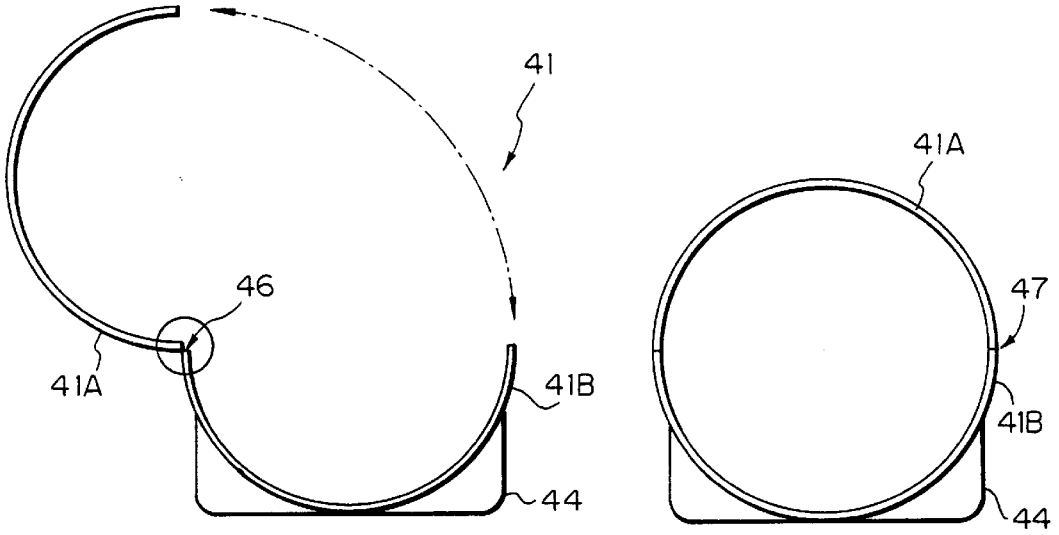
Fig. 15A PRIOR ART
FIG. 15A shows the cover member in an open position and a closed position.
Figure 15B:
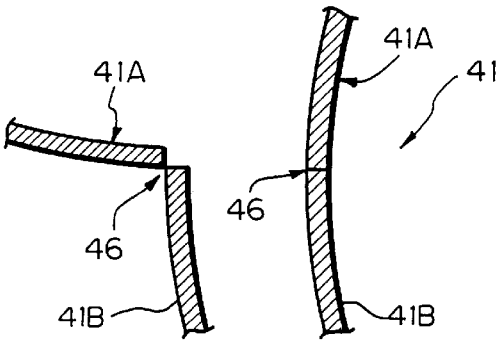
Fig. 15B PRIOR ART
FIGS. 15B and 15C are enlarged views respectively showing a hinge portion and an engaging portion included in the cover member.
Figure 15C:
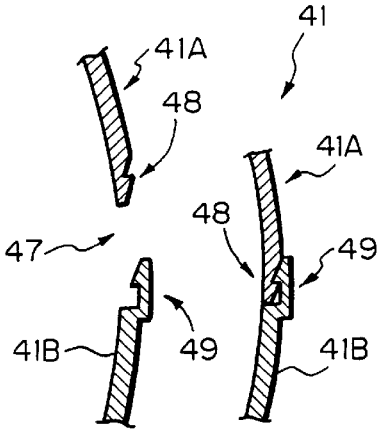
Fig. 15C PRIOR ART

The cover member 41 will be described more specifically with reference to FIGS. 14A, 14B,15A, 15B and 15C. FIGS. 14A and 14B show the cover member 41 in an open position and a closed position, respectively. FIG. 15A shows the open position and closed position of the cover member 41. FIGS. 15B and 15C respectively show a hinge portion and a locking portion included in the cover member 41.

The seats 44 are formed integrally with the cover member 41, as stated above. An opening 45 is formed in the cover member 41 and faces the belt 1 when the developing unit 6 is mounted to the apparatus body. The cover 41 has a comparatively thin hinge portion 46 and an openable engaging portion 47 in part of its circumference. The hinge portion 46 and engaging portion 47 extend over the entire axial length of the cover member 41 substantially symmetrically to each other. The cover member 41 is made up of an upper cover part 41A and a lower cover part 41B separable from each other. The two cover parts 41A and 41B are connected together by the hinge portion 46 and openable away from each other about the hinge portion 46. The engaging portion 47 is implemented by locking members 48 and 49 belonging to the upper cover part 41A and lower cover part 41B, respectively.

Figure 16:
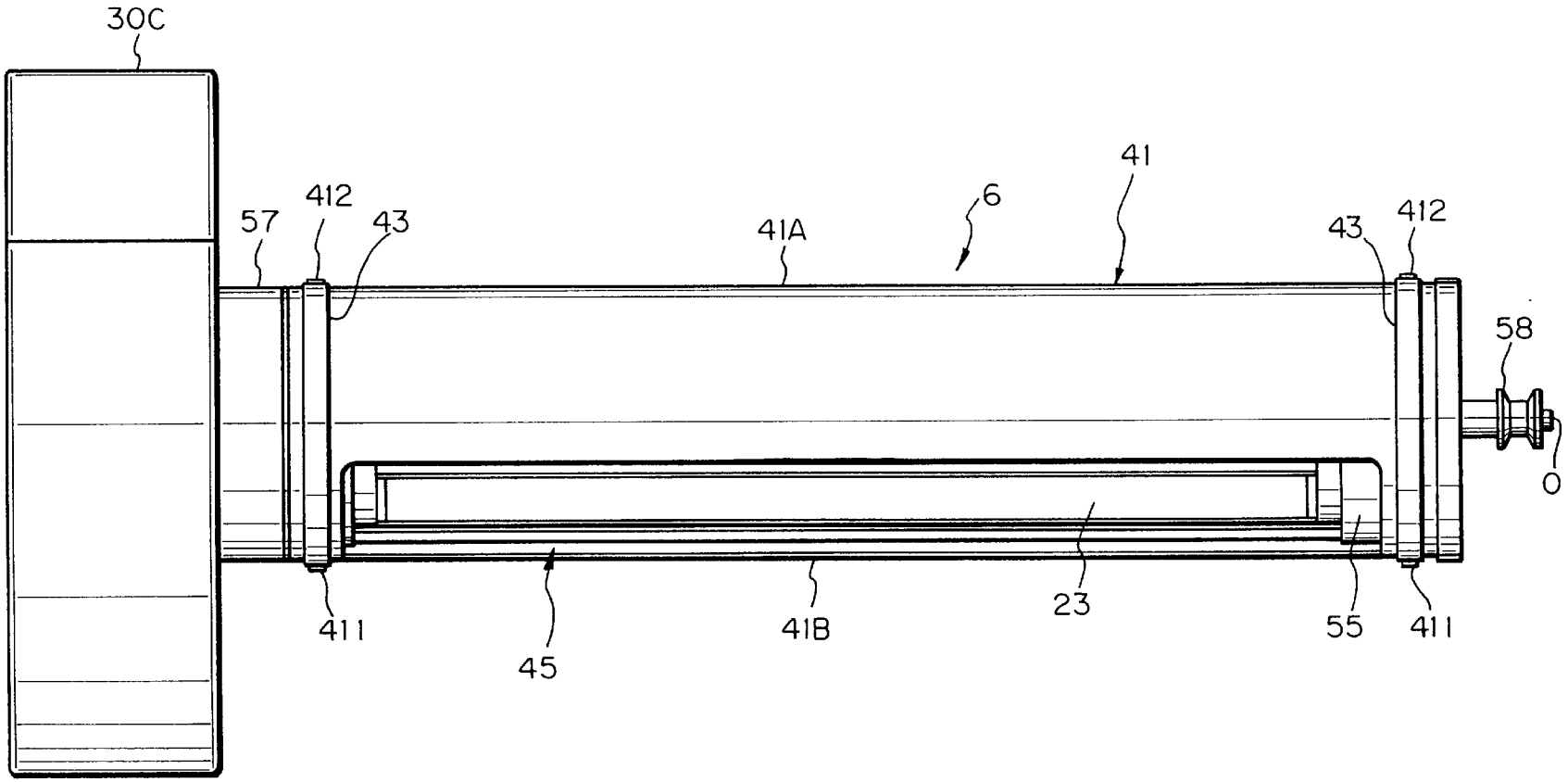
Fig. 16 PRIOR ART
FIG. 16 is a side elevation of the color developing unit.

Reference will be made to FIGS. 14 and 16 for describing straps 43 used to mount and dismount the color developing unit 6. The straps 43 are respectively fitted on the opposite end portions of the cover member 41 and capable of closely contacting the outer periphery of the cover member 41. The operator mounts or dismounts the developing unit 60 to or from the apparatus by holding the straps 43. Assume that the operator removes the developing unit 6 from the apparatus body in order to leave it outside of the apparatus body or mounts or dismounts it to or from the apparatus body by holding the straps 43. Then, the weight of the body of the developing unit including the developing sections acts on the lower cover part 41B. As a result, the body of the developing unit is prevented from rotating relative to the cover member 41 because of friction acting between the inner periphery of the cover member 41 and the circumferences of the slide portions 55A and 57A of the end plates 55 and 57.

Conversely, when the developing unit 6 is mounted to the apparatus body, only the weight of the cover member 41 acts on the body of the color developing unit between the cover 41 and the slide portions 55A and 57A of the end walls 55 and 57. The resulting friction is therefore so small, the developing sections 22 of the body of the developing unit can easily slide on the cover 41.

Figure 17C:
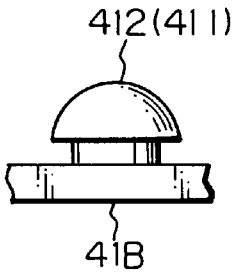
Fig. 17C PRIOR ART
FIG. 17C is an enlarged view of a projection formed on the cover member.

Projections 411 and 412 are formed on the lower cover part 41B on which the weight of the body of the color developing unit acts at the time of mounting and dismounting. As shown in FIG. 17C, each of the projections 411 and 412 has a mushroom-like configuration.

Figure 17B:
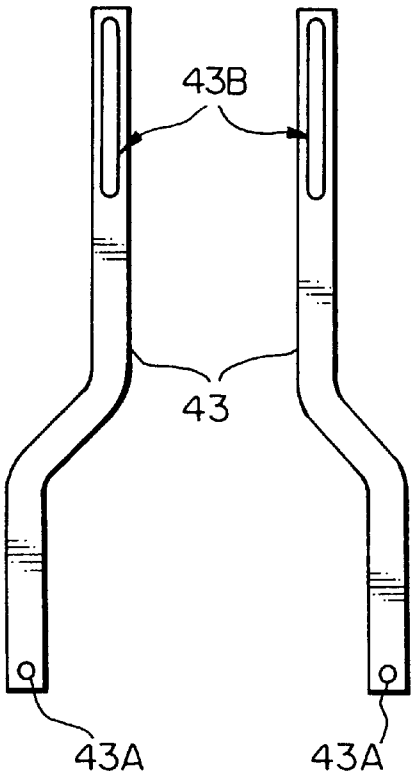
Fig. 17B PRIOR ART
FIGS. 17A and 17B are developed plan views each showing a particular configuration of straps to be fitted on the cover member.
Figure 17A:
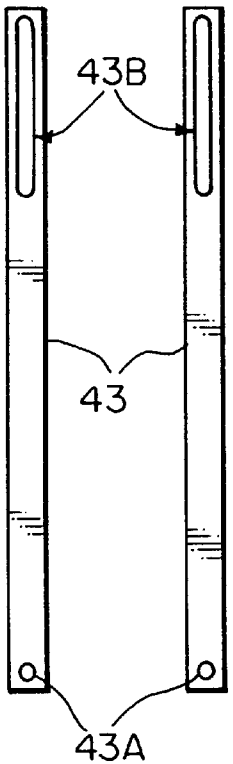
Fig. 17A PRIOR ART

The straps 43 are implemented as sheets formed of polypropylene, polyethylene or similar flexible material. To reduce the kinds of parts, it is preferable to provide the straps 43 with an identical shape, as shown in FIG. 17A, or with symmetrical shapes, as shown in FIG. 17B. The straps 43 having the symmetrical shapes shown in FIG. 17B can be used either face up or face down. A hole 43A and an elongate slot 43B are formed in each of the straps 43. The straps 43 each have the hole 43A and slot 43B fitted on the projections 411 and 412 of the cover member 41. When operator lifts the straps 43, the straps 43 slide with the slots 43B moving along the lugs 412. As a result, as shown in FIG. 19A, a space 413 is formed between each strap 43 and the outer periphery of the cover member 41. Then, the operator can puts fingers in such spaces 413 so as to mount or dismount or replace the color developing unit 6.

Because the straps 43 are fitted on the lower cover part 41B, the lower cover part 41B can bear the weight of the body of the developing unit acting during mounting or dismounting or during replacement. It follows that the hinge portion 46 and engaging portion 47 should only be strong enough to prevent the cover member 41 from opening. In addition, the operator can mount, dismount or replace the developing unit 6 easily and safely.

Figure 18:
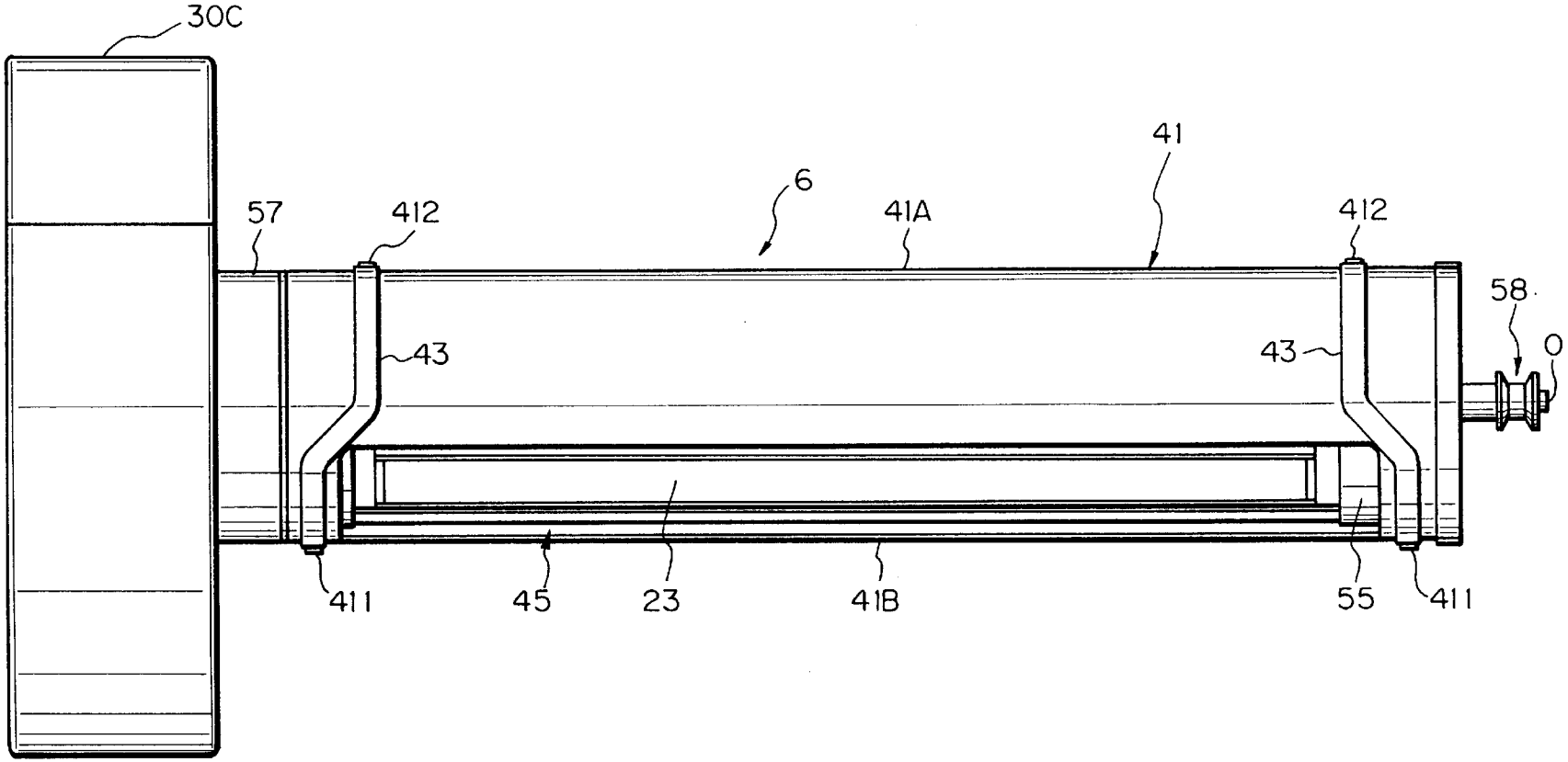
Fig. 18 PRIOR ART
FIG. 18 is a side elevation showing the color developing unit provided with modified straps.

As shown in FIGS. 17B and 18, the portions of the straps 43 to be held by the operator may be shifted axially inward away from the opposite ends of the cover member 41. This configuration provides a sufficient distance between the toner cartridges 30 or the members of the apparatus body adjoining the developing unit and the above portions of the straps 43. The operator can therefore easily hold the straps 43 and is protected from injury. Of course, the straps 43 may be positioned as close to the opposite ends of the cover member 41 as possible, in which case the opening 45 can be made sufficiently long without increasing the length of the body of the developing unit.

Figure 19B:
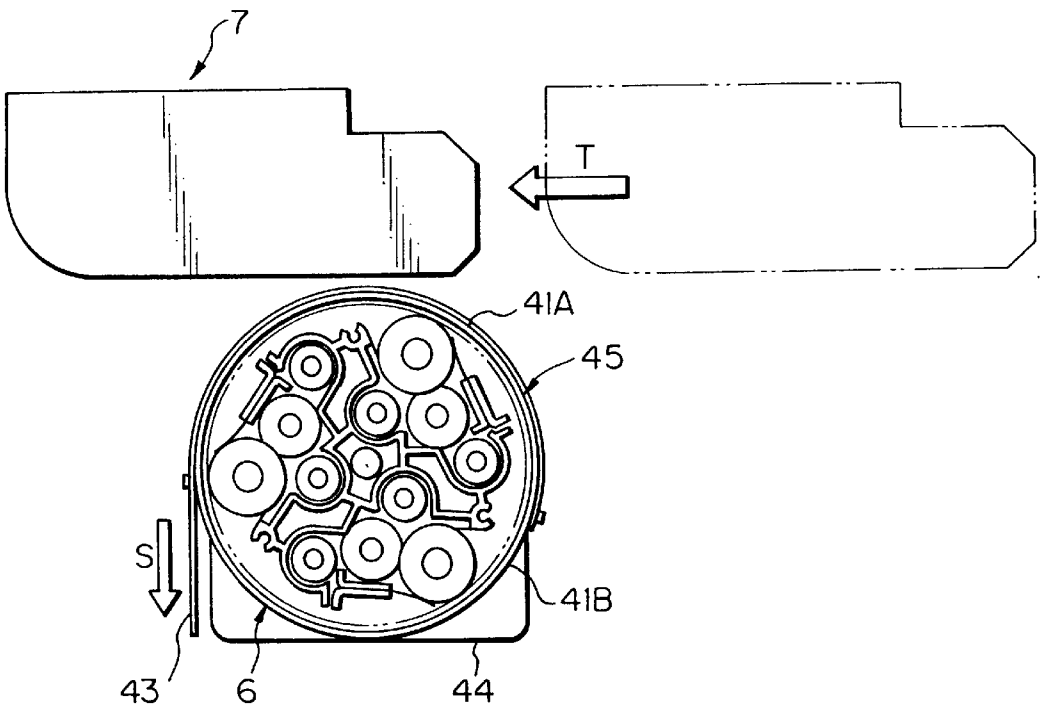
Fig. 19B PRIOR ART
FIGS. 19A and 19B show how the straps are automatically retracted onto the color developing unit.
Figure 19A:
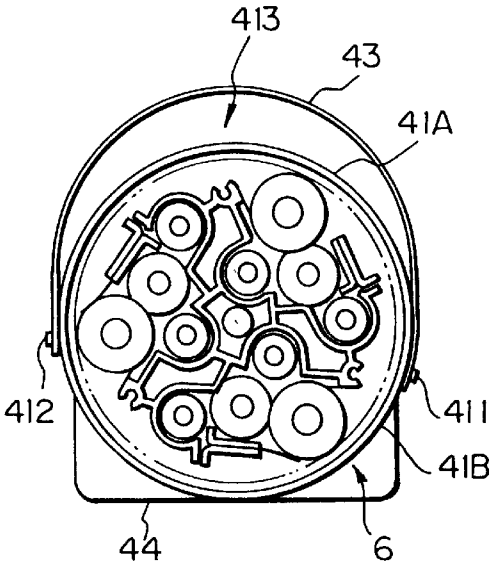
Fig. 19A PRIOR ART

FIGS. 19A and 19B show how the straps 43 are retracted when not used. As shown in FIG. 19A, assume that when the developing unit 6 is mounted to the apparatus body, the straps 43 are left in their lifted positions. Then, they interfere with the other units and parts to be mounted to the apparatus body after the developing unit 6 and prevent them from being positioned at their expected positions. This is apt to cause the units to malfunction, bring about defective images, or damage the parts.

In light of the above, as shown in FIG. 19B, the straps 43 are retracted in a direction indicated by an arrow S. Specifically, when the black developing unit 7 is mounted to the apparatus body in a direction T after the color developing unit 6, the developing unit 7 presses the straps 43 downward with its bottom. As a result, the straps 43 are retracted from the lifted positions in the direction S and caused to closely contact the cover member 41. If desired, an arrangement may be made such that the straps 43 retract in inter locked relation to the setting of the process cartridge 31 or the body frame 8.

While the above apparatus uses an intermediate transfer system using the intermediate transfer belt 10, a plurality of images of different colors may be sequentially formed on the belt 1 one above the other.

As stated above, in the conventional color image forming apparatus, the cover member 41 surrounds the color developing unit 6. The cover member 41 prevents toner from flying out of the developing sections of the unit 6 and contaminating the inside of the apparatus or from being mixed with the black toner. However, if the mechanical strength of the cover member 41 is short, the cover member 41 is likely to deform when, e.g., the black developing unit 7 contacts the cover member 41 during mounting or dismounting. The deformation of the cover member 41 would damage the developing rollers and other constituents of the developing sections. Further, when the hollow cylindrical cover member 41 is implemented by a molding of resin, the cover member 41 is apt to bend, distort or otherwise deform during molding or machining. The bend or distortion of the cover member 41 would also damage the structural elements of the developing sections or would cause toner on the developing rollers to fly about.

Figure 20:
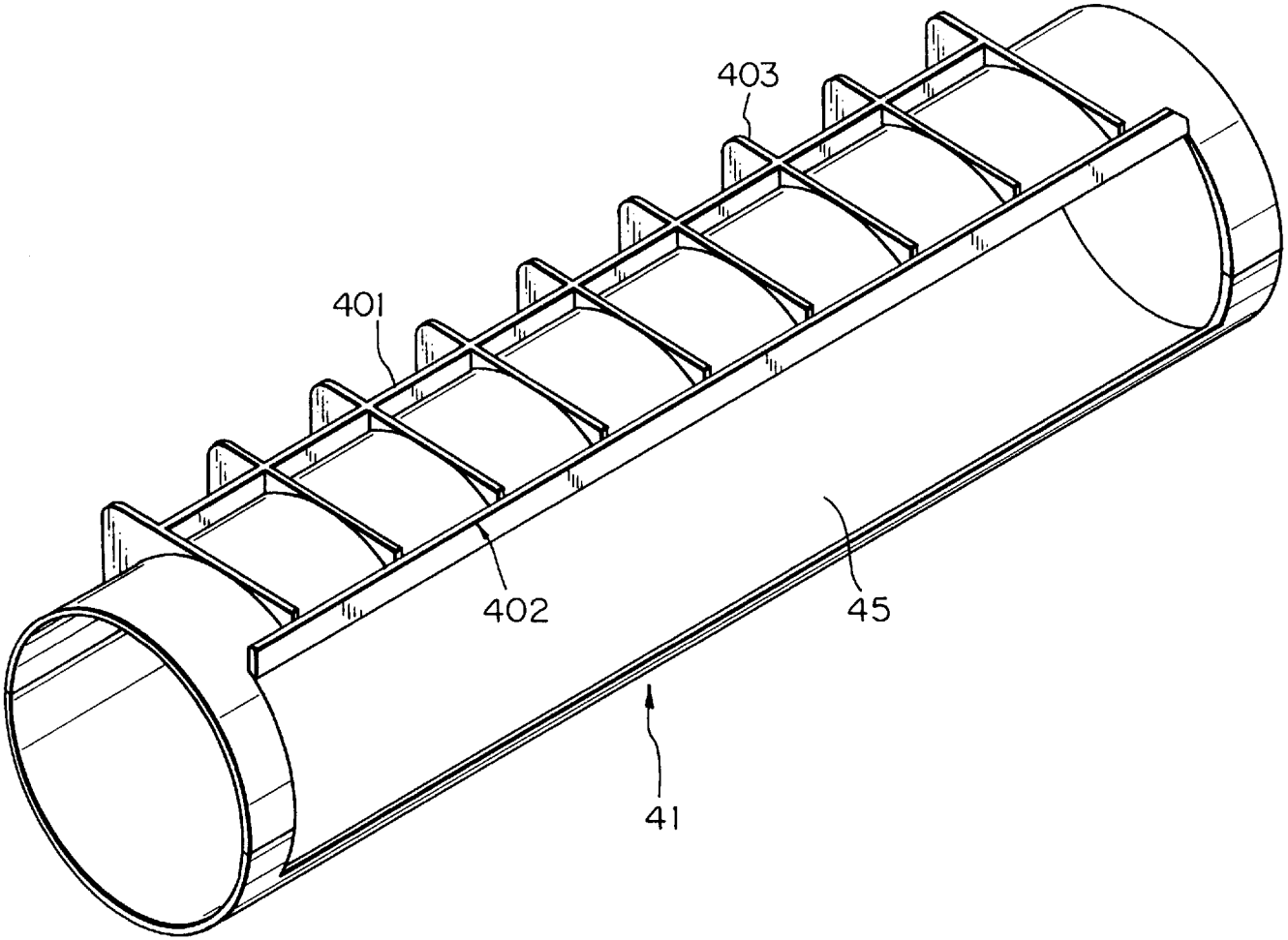
FIG. 20 is a perspective view of a cover member included in an image forming apparatus embodying the present invention.

Referring to FIG. 20, an image forming apparatus embodying the present invention will be described. Because the illustrative embodiment is basically similar to the above conventional apparatus, the following description will concentrate on structural features unique to the embodiment. As shown in FIG. 20, a cover member 41 included in the illustrative embodiment is formed with first ribs 401 and 402 on its upper portion expected to face the black developing unit 7. The ribs 401 and 402 extend in the axial direction of the center shaft 0 and increase the mechanical strength of the cover member 41 in the above axial direction. This is successful to reduce the bend, distortion or similar deformation of the cover member 41. An opening 45 is formed in the cover 41.

Further, a plurality of second ribs 403 perpendicular to the first ribs 401 and 402 are formed on the cover member 41, and each has a flat top parallel to the direction in which the black developing unit 7 is mounted and dismounted. The ribs 403 further increase the mechanical strength of the cover member 41 and reduce the deformation of the cover member 41 more positively. In addition, the flat tops of the second ribs 403 parallel to the above direction serve to guide the black developing unit 7. This makes it needless to provide an extra member for guiding the black developing unit 7.

As stated above, in the illustrative embodiment, the first ribs 401 and 402 reduce the deformation of the cover member 41 and thereby protect the developing rollers of the color developing unit from damage while allowing a minimum of toner to fly about. The second ribs 403 additionally reduce the deformation of the cover member 41. The tops of the cover 41 guide the black developing unit 7 and promote easy mounting and dismounting of the developing unit 7. This obviates the need for an extra guide member and therefore reduces the initial cost.

Figures 21A, 21B:
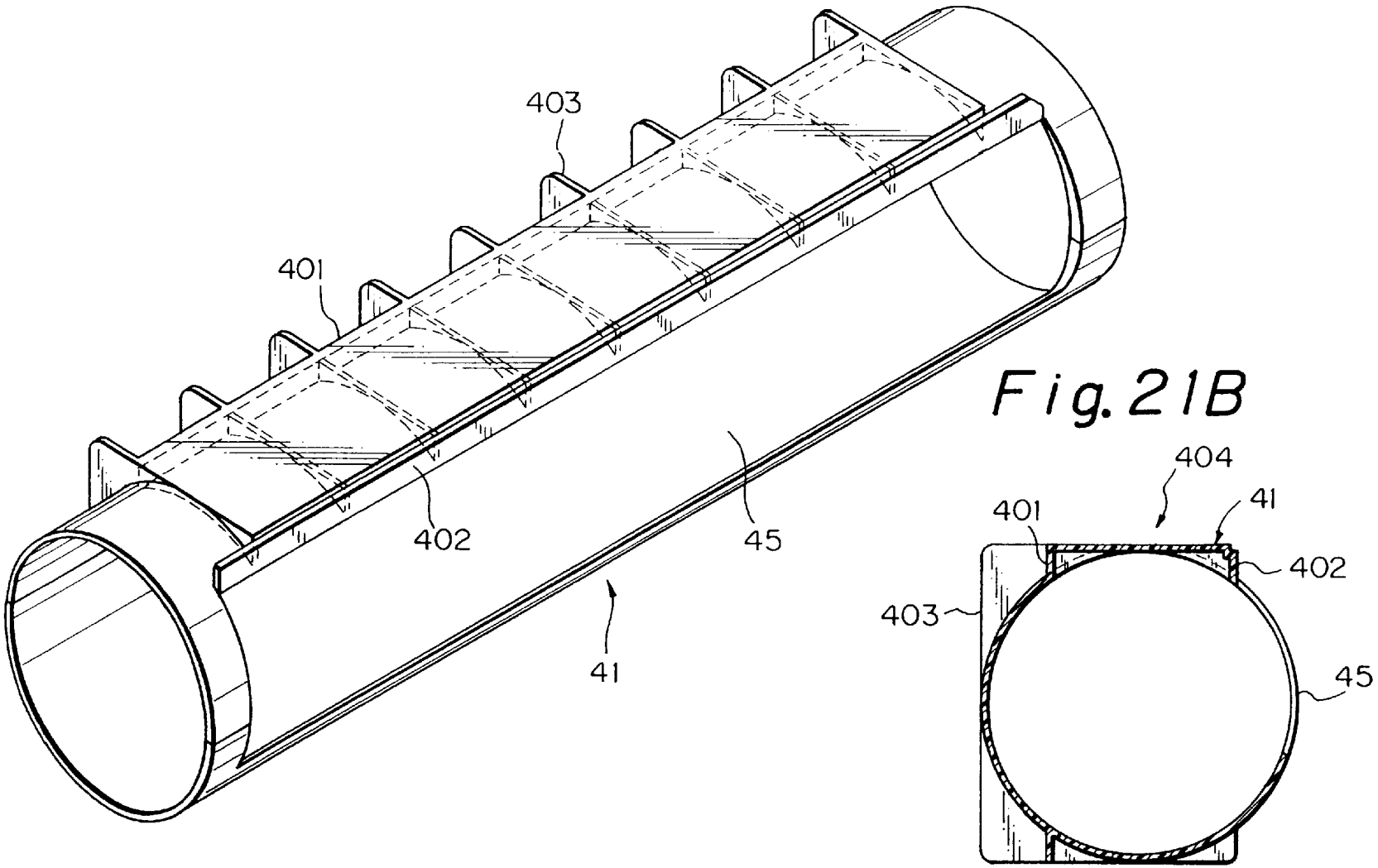
FIGS. 21A and 21B are respectively a perspective view and a section showing the cover member of the illustrative embodiment.

FIGS. 21A and 21B show a more specific configuration of the cover member 41. As shown, the cover member 41 has a flat surface 404 on the second ribs 403. The flat surface 404 is parallel to the direction in which the black developing unit 7 is mounted and dismounted. The flat surface 404 readily shows the operator that it constitutes a guide for the black developing unit 7. If desired, an arrow representative of a mounting and dismounting direction and a procedure may be provided on the flat surface 404 by molding or in the form of a decal or seal.

Figure 22A:
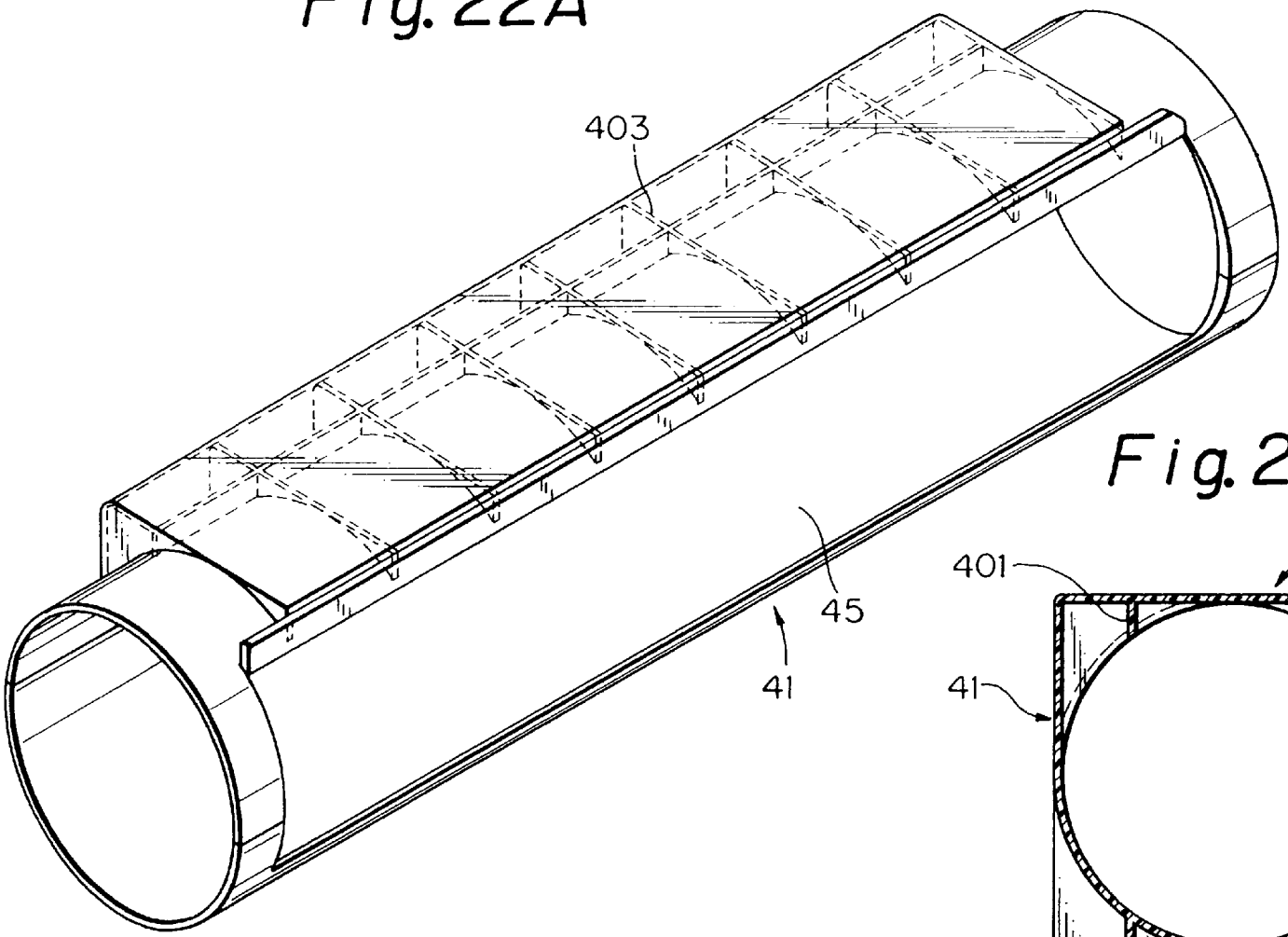
FIGS. 22A and 22B are respectively a perspective view and a section showing a modified form of the cover member included in the illustrative embodiment.
Figure 22B:
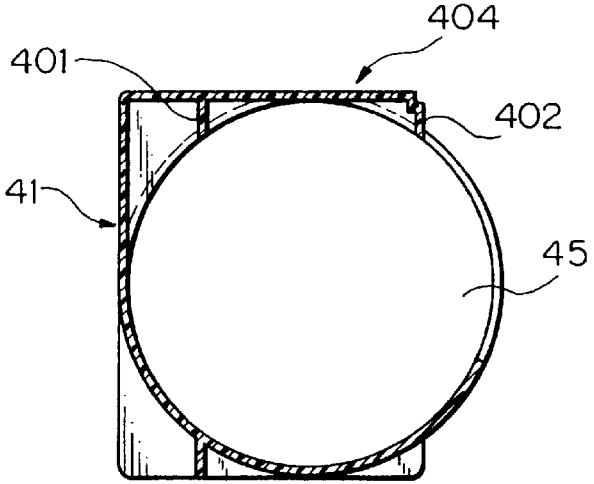

FIGS. 22A and 22B show a modification of the illustrative embodiment. As shown, the modification includes a member tying the sides of the second rib members 403. This member further increases the mechanical strength of the cover 41.

Figure 23:
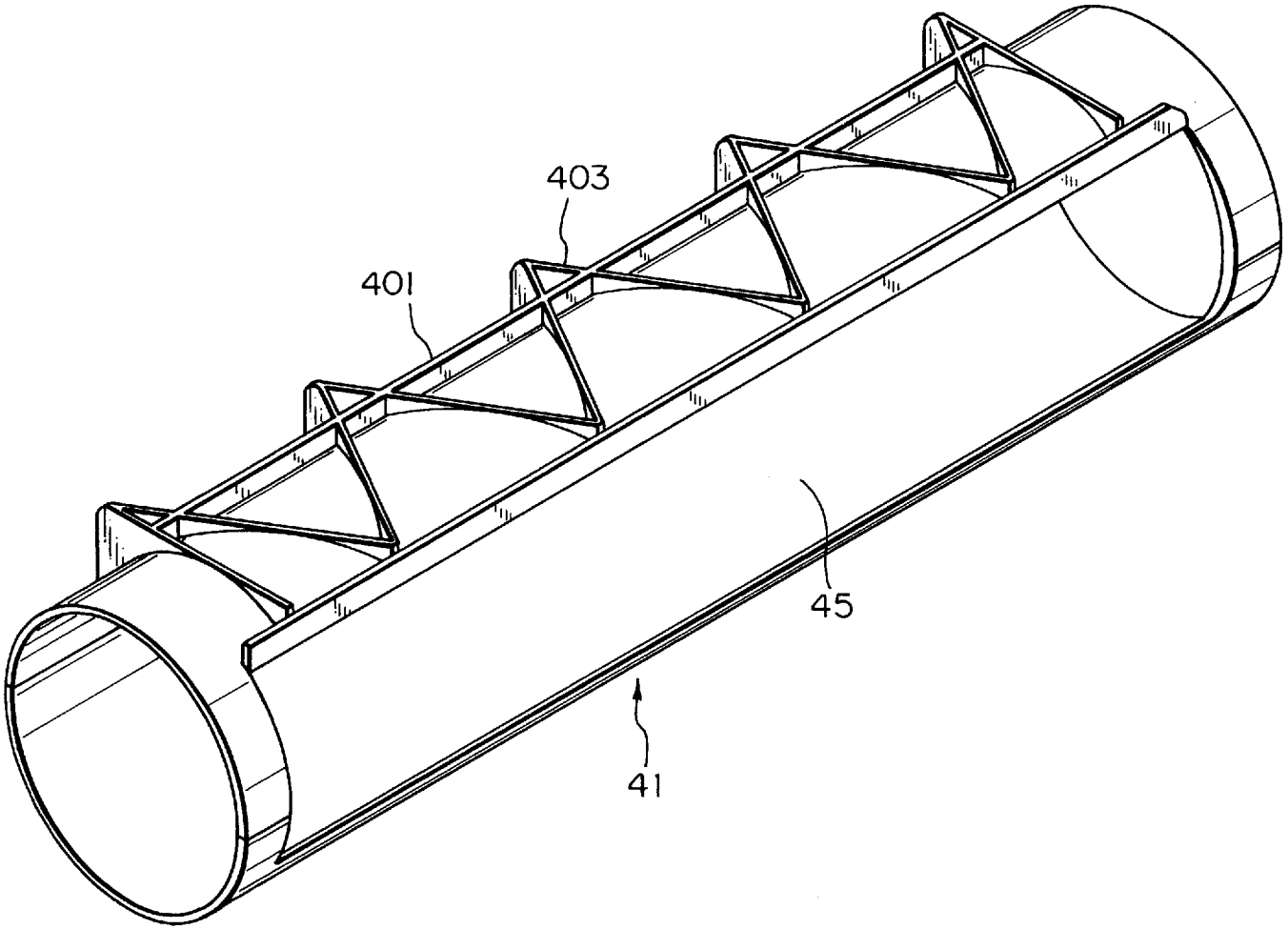
FIG. 23 is a perspective view showing another modified form of the cover member included in the illustrative embodiment.

The ribs 401, 402 and 403 may be implemented as members separate from the cover member 41 and affixed to the cover member 41. As shown in FIG. 23, the second ribs 403 may be inclined relative to the first ribs 401 and 402.

In summary, in accordance with the present invention, a cover member deforms little and therefore reduces damage to developing rollers included in a revolver type developing unit and the scattering of toner. The top of the cover member is implemented as a guide for guiding another developing unit and therefore allows it to be easily mounted and dismounted. This obviates the need for an extra guide member and thereby reduces the initial cost. The operator can easily see that the top of the cover member is the above guide and will therefore surely use the top when mounting or dismounting the developing unit.

Various modifications will become possible for those skilled in the art after receiving the teachings of the present disclosure without departing from the scope thereof.

What is claimed is:

1. An image forming apparatus comprising:

an image carrier for forming a latent image thereon;

a revolver type first developing unit having a plurality of developing sections arranged around a rotary shaft; and a cover member having a cylindrical portion and covering said plurality of developing sections and formed with an opening at a developing position facing said image carrier;

said first developing unit being rotatable to locate any one of said plurality of developing sections at the developing position to thereby develop the latent image;

said cover member including first ribs extending in an axial direction of said rotary shaft and protruding outward from an external surface of said cylindrical portion of said cover member, said cover member further including a flat member extending between ends of said first ribs.

2. An image forming apparatus as claimed in claim 1, further comprising a second developing unit removably mounted above said first developing unit and facing said image carrier at a position different from the developing position for developing the latent image derived from black image data with a black developer, said plurality of developing sections sequentially developing respective latent images of different colors other than black with developers of corresponding colors.

3. An image forming apparatus as claimed in claim 2, wherein a second ribs extend in a direction different from a direction in which said first ribs extend.

4. An image forming apparatus as claimed in claim 3, wherein said second developing unit is supported on a top of said cover member when being moved in a mounting and dismounting direction.

5. An image forming apparatus as claimed in claim 4, wherein said second ribs are formed in a direction parallel to the mounting and dismounting direction, said second ribs supporting said second developing unit being moved in said mounting and dismounting direction.

6. An image forming apparatus as claimed in claim 4, wherein said cover member is formed with a flat surface on a top for supporting said second developing unit being moved in the mounting and dismounting direction.

7. An image forming apparatus comprising:

an image carrier for forming a latent image thereon;

a revolver type first developing unit having a plurality of developing sections arranged around a rotary shaft; and a cover member covering said plurality of developing sections and formed with an opening at a developing position facing said image carrier;

said first developing unit being rotatable to locate any one of said plurality of developing sections at the developing position to thereby develop the latent image;

said cover member including first ribs extending in an axial direction of said rotary shaft;

said cover member including second ribs extending in a direction different from a direction in which said first ribs extend.

8. An image forming apparatus as claimed in claim 7 wherein a second developing unit is supported on a top of said cover member when being moved in a mounting and dismounting direction.

9. An image forming apparatus as claimed in claim 8, wherein said second ribs are formed in a direction parallel to the mounting and dismounting direction, said second ribs supporting said second developing unit being moved in said mounting and dismounting direction.

10. An image forming apparatus as claimed in claim 8, wherein said cover member is formed with a flat surface on a top for supporting said second developing unit being moved in the mounting and dismounting direction.

11. An image forming apparatus as claimed in claim 7, further comprising a second developing unit removably mounted above said first developing unit and facing said image carrier at a position different from the developing position for developing the latent image derived from black image data with a black developer, said plurality of developing sections sequentially developing respective latent images of different colors other than black with developers of corresponding colors.

12. An image forming apparatus as claimed in claim 7, wherein said cover member further includes a flat member extending between ends of said first ribs.

13. A cover for a developing unit of an image forming apparatus having an image carrier, the developing unit having a plurality of developing sections arranged around a rotary shaft, said cover comprising:

a cover member having a cylindrical portion and configured to cover the plurality of developing sections and provided with an opening at a developing position facing the image carrier, said cover member including first ribs extending parallel to an axial direction of the rotary shaft and protruding outward from an external surface of said cylindrical portion of said cover member, said cover member further including a flat member extending between ends of said first ribs.

14. The cover according to claim 13, wherein said cover member further comprises second ribs extending in a direction different from a direction in which said first ribs extend.

15. The cover according to claim 14, wherein said cover is configured to support a second developing unit thereon when being moved in a mounting and dismounting direction.

16. The cover according to claim 15, wherein said second ribs are formed in a direction parallel to the mounting and dismounting direction, said second ribs being configured to support the second developing unit being moved in the mounting and dismounting direction.

17. A cover for a developing unit of an image forming apparatus having an image carrier, the developing unit having a plurality of developing sections arranged around a rotary shaft, said cover comprising:

a cover member configured to cover the plurality of developing sections and provided with an opening at a developing position facing the image carrier, said cover member including first ribs extending parallel to an axial direction of the rotary shaft and second ribs extending in a direction different from a direction in which said first ribs extend.

18. The cover according to claim 17, wherein said cover is configured to support a second developing unit thereon when being moved in a mounting and dismounting direction.

19. The cover according to claim 18, wherein said second ribs are formed in a direction parallel to the mounting and dismounting direction, said second ribs being configured to support the second developing unit being moved in the mounting and dismounting direction.

20. The cover according to claim 17, wherein said cover member further includes a flat member extending between ends of said first ribs.

* * * * *

UNITED STATES PATENT AND TRADEMARK OFFICE

CERTIFICATE OF CORRECTION

PATENT NO. : 6,122,470

DATED : September 19, 2000

INVENTOR(S): Noriyuki Kimura

It is certified that an error appears in the above-identified patent and that said Letters Patent is hereby corrected as shown below:

On the title page, Item [54], and at the top of Column 1, the title should be:

---[54] AN IMAGE FORMING APPARATUS HAVING A DEVELOPING UNIT COVER---

Signed and Sealed this

Fifteenth Day of May, 2001

*Attest:*

Nicholas P. Godici

NICHOLAS P. GODICI

*Attesting Officer*

*Acting Director of the United States Patent and Trademark Office*